US012207777B2

(12) United States Patent
Nam et al.

(10) Patent No.: US 12,207,777 B2
(45) Date of Patent: Jan. 28, 2025

(54) DISH WASHER AND METHOD FOR CONTROLLING THE SAME

(71) Applicant: SAMSUNG ELECTRONICS CO., LTD., Suwon-si (KR)

(72) Inventors: Joowan Nam, Suwon-si (KR); Woojin Shin, Suwon-si (KR); Sanghee Kwon, Suwon-si (KR); Jongwook Kwon, Suwon-si (KR); Jihyeon Park, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 17/950,652

(22) Filed: Sep. 22, 2022

(65) Prior Publication Data

US 2023/0157515 A1 May 25, 2023

Related U.S. Application Data

(63) Continuation of application No. PCT/KR2022/014041, filed on Sep. 20, 2022.

(51) Int. Cl.
*A47L 15/42* (2006.01)
*A47L 15/46* (2006.01)

(52) U.S. Cl.
CPC ..... *A47L 15/4208* (2013.01); *A47L 15/4219* (2013.01); *A47L 15/4293* (2013.01);
(Continued)

(58) Field of Classification Search
CPC ..... A47L 15/4208; A47L 15/4219; A47L 15/4293; A47L 15/46; A47L 2401/20;
(Continued)

(56) References Cited

U.S. PATENT DOCUMENTS 7,758,703 B2 7/2010 Lee et al.
9,861,253 B2 1/2018 Lee et al.
(Continued)

FOREIGN PATENT DOCUMENTS

CN 11345761 A 6/2020
CN 117794436 A * 3/2024 ..... A47L 15/00
(Continued)

OTHER PUBLICATIONS

International Search Report dated Jan. 12, 2023 issued in PCT Application No. PCT/KR2022/014041.
(Continued)

*Primary Examiner* — Alexander Markoff
(74) *Attorney, Agent, or Firm* — STAAS & HALSEY LLP

(57) ABSTRACT

A dish washer includes a cabinet; a tub in the cabinet; a sump underneath the tub; a case brake on a side wall of the tub and connected to the sump; a water supply valve connected to an external water supply source; a filter assembly between the water supply valve and the case brake and including a plurality of flow path valves to open or close a plurality of flow paths corresponding to the plurality of flow path valves to guide water supplied from the external water supply source to the case brake; and a processor configured to open the water supply valve and one of the plurality of flow path valves at different points in time to start supplying the water and close the water supply valve and the one of the plurality of flow path valves at different points in time to stop the supplying of the water.

20 Claims, 19 Drawing Sheets

(52) U.S. Cl.
CPC ..... *A47L 15/46* (2013.01); *A47L 2401/20* (2013.01); *A47L 2501/01* (2013.01); *A47L 2501/26* (2013.01)

(58) Field of Classification Search
CPC ..... A47L 2501/01; A47L 2501/26; A47L 2401/22; A47L 2401/34; A47L 2501/03; A47L 15/4217; A47L 15/4229; A47L 15/0049; A47L 15/4206
See application file for complete search history.

(56) References Cited

U.S. PATENT DOCUMENTS

| | | | | |
|---|---|---|---|---|
| 9,951,451 | B2 * | 4/2018 | Park | D06F 34/05 |
| 10,716,449 | B2 | 7/2020 | Balinski et al. | |
| 2006/0081272 | A1 * | 4/2006 | Jung | A47L 15/0049 134/18 |
| 2010/0102051 | A1 * | 4/2010 | Ebrom | H04L 69/26 219/520 |
| 2010/0106265 | A1 * | 4/2010 | Ebrom | H04L 69/26 700/90 |
| 2012/0204912 | A1 | 8/2012 | Druecker et al. | |
| 2013/0104935 | A1 * | 5/2013 | Gnadinger | A47L 15/0049 134/110 |
| 2013/0112225 | A1 * | 5/2013 | Im | A47L 15/0021 134/57 D |
| 2014/0060590 | A1 | 3/2014 | Aras et al. | |
| 2017/0135550 | A1 * | 5/2017 | Shin | A47L 15/0049 |
| 2019/0031530 | A1 * | 1/2019 | Kitagawa | C02F 1/008 |
| 2019/0190739 | A1 * | 6/2019 | Guinard | G05B 15/02 |
| 2021/0068612 | A1 | 5/2021 | Park | |
| 2022/0125276 | A1 | 4/2022 | Kim et al. | |
| 2023/0041312 | A1 * | 2/2023 | Yeom | A47L 15/0023 |
| 2023/0157515 | A1 * | 5/2023 | Nam | A47L 15/4217 134/18 |

FOREIGN PATENT DOCUMENTS

| | | | | |
|---|---|---|---|---|
| DE | 10 2010 031 522 | A1 | 1/2012 | |
| EP | 3 666 153 | B1 | 9/2021 | |
| EP | 4353138 | A1 * | 4/2024 | A47L 15/00 |
| KR | 10-0711032 | B1 | 4/2007 | |
| KR | 10-0717472 | | 5/2007 | |
| KR | 10-1065697 | | 9/2011 | |
| KR | 10-2015-0029416 | | 3/2015 | |
| KR | 10-2018-0054192 | | 5/2018 | |
| KR | 10-2022-0053422 | | 4/2022 | |
| KR | 10-2022-0053423 | | 4/2022 | |
| KR | 2023077134 | A * | 6/2023 | A47L 15/00 |
| WO | WO 2008/016283 | A1 | 2/2008 | |
| WO | WO 2020/234227 | A1 | 11/2020 | |

OTHER PUBLICATIONS

European Search Report dated Oct. 2, 2024 issued in European Application No. EP 22 89 8805.

* cited by examiner

DISH WASHER AND METHOD FOR CONTROLLING THE SAME

CROSS-REFERENCE TO RELATED APPLICATIONS

This application is a continuation application, under 35 U.S.C. § 111(a), of International Patent Application No. PCT/KR2022/014041, filed on Sep. 20, 2022, which claims the benefit of Korean Patent Application No. 10-2021-0164069, filed Nov. 25, 2021, in the Korean Intellectual Property Office, the entire disclosure of which is incorporated herein by reference as a part of this application.

BACKGROUND

Field

The disclosure relates to a dish washer and method for controlling the same.

Description of Related Art

In general, dish washers refer to devices for cleaning dishes received therein by spraying high pressure water at the dishes and then drying the dishes. The dish washer operates such that water is sprayed at high pressure in a washing tub where the dishes are received and the spray of water reaches the dishes to wash off dirt such as food soiling on the surface of the dishes.

Specifically, the dish washer includes a tub with the washing tub formed therein and a sump installed underneath the tub to store water for washing. The water is moved into a spray nozzle by pumping action of a washing pump installed in the sump, and the water moved into the spray nozzle is sprayed at high pressure through a spray port formed at an end of the spray nozzle. The water sprayed at high pressure hits the surface of the dish to make dirt such as food soiling stuck to the dish falls to the bottom of the tub.

In the dish washer, water for washing is collected in the sump to be supplied into the tub. In this case, there is a demand for purified water to be collected in the sump.

SUMMARY

According to an embodiment of the disclosure, a dish washer includes a cabinet; a tub in the cabinet; a sump underneath the tub; a case brake on a side wall of the tub and connected to the sump; a water supply valve connected to an external water supply source; a filter assembly between the water supply valve and the case brake and including a plurality of flow path valves to open or close a plurality of flow paths corresponding to the plurality of flow path vales to guide water supplied from the external water supply source to the case brake; and a processor configured to open the water supply valve and one of the plurality of flow path valves at different points in time to start supplying the water, and close the water supply valve and the one of the plurality of flow path valves at different points in time to stop the supplying of the water.

The plurality of flow paths may include a filtering flow path and a bypass flow paths, and the plurality of flow path valves may include a first flow path valve to open or close the filtering flow path in which water supplied from the water supply source passes through a filter in the filter assembly and flows to the case brake; and a second flow path valve to open or close the bypass flow path in which water supplied from the water supply path bypasses the filter and flows to the case brake.

The processor may open the water supply valve after opening the first flow path valve or the second flow path valve first to start the supplying of the water.

The processor may close the first flow path valve or the second flow path valve after closing the water supply valve first to stop the supplying of the water.

The processor may control the first flow path valve or the second flow path valve to open one of the filtering flow path and the bypass flow path, based on at least one process included in a washing course.

The processor may control the first flow path valve to open the filter flow path for a last rinsing process of the at least one process.

The processor may determine whether to provide a notification of a filter replacement based on at least one of a number of times that the first flow path valve has opened, hours that the first flow path valve has opened and a period elapsed after installation of the filter.

The processor may accumulate the number of times that the first flow path valve has opened and control a user interface to provide the notification of the filter replacement based on the accumulated number of times being equal to a preset limited number.

The processor may determine hours of use of the filter by accumulating the hours of the first flow path valve has opened, and control the user interface to provide the notification of the filter replacement based on the hours of use of the filter being equal to preset limited hours.

The processor may control the user interface to provide the notification of the filter replacement based on a period of time elapsed after the installation of the filter corresponding to a recommended period of time for the filter replacement.

The dish washer may further include a flowmeter measuring an amount of water flowing into the case brake, and the processor may calculate an accumulated amount of water having passed through the filter and flowing into the case brake after the first flow path valve is opened, and determining whether to provide the notification of the filter replacement based on the accumulated amount of water calculated.

The processor may be further configured to sequentially open the water supply valve at a first point in time and the one of the plurality of flow path valves at a second point in time to start the supplying of the water, and sequentially close the water supply valve at a third point in time and the one of the plurality of flow path valves at a fourth in time to stop the supplying of the water.

According to an embodiment of the disclosure, a method of controlling a dish washer a sump, and a case brake connected to the sump, may include determining, by the processor, at least one process to perform included in a washing course, determining whether to operate a water supply valve connected to an external water supply source and one of a plurality of flow path valves included in a filter assembly located between the water supply valve and a case brake to open or close a plurality of flow paths corresponding to the plurality of flow path valves to guide water supplied from the external water supply source to the case brake, based on the determined at least one process; in response to the determining whether to operate of opening the water supply valve and one of the plurality of flow path valves at different points in time to start supplying the water; and closing the water supply valve and the one of the plurality of flow path valves at different points in time to stop the supplying of the water.

The plurality of flow path valves may include a first flow path valve to open or close a filtering flow path in which the water supplied from the external water supply source passes through a filter in the filter assembly and flows to the case brake; and a second flow path valve to open or close a bypass flow path in which the water supplied from the external water supply source bypasses the filter and flows to the case brake, and the determining of whether to operate of may include determining whether to operate the first flow path valve or the second flow path valve to open the one of the filtering flow path and the bypass flow path, based on the determined at least one process.

The opening may include opening of the water supply valve and one of the plurality of flow path valves the water supply valve after opening the first flow path valve or the second flow path valve first to start the supplying of the water.

The closing of the water supply valve and one of the plurality of flow path valves may include closing the first flow path valve or the second flow path valve after closing the water supply valve first to stop the supplying of the water.

The operation of the first flow path valve to open the filtering flow path may be performed in a last rinsing process of the at least one process.

The method may further include determining whether to provide a notification of a filter replacement based on at least one of a number of times that the first flow path valve has opened, hours that the first flow path valve has opened or a period of time elapsed after an installation of the filter.

The determining of whether to provide the notification of the filter replacement may include accumulating the number of times that the first flow path valve has opened; and providing the notification of the filter replacement based on the accumulated number of times being equal to a preset limited number.

The determining of whether to provide the notification of the filter replacement may include determining hours of use of the filter by accumulating hours that the first flow path valve has opened; and providing the notification of the filter replacement based on the hours of use of the filter being equal to preset limited hours.

The determining of whether to provide the notification of the filter replacement may include providing the notification of filter replacement based on the period of time elapsed after the installation of the filter corresponding to a recommended period of time for the filter replacement.

The opening of the water supply valve and the one of the plurality of flow path valves may further comprise sequentially opening the water supply valve at a first point in time and the one of the plurality of flow path valves at a second point in time to start the supplying of the water, and the closing of the water supply valve and the one of the plurality of flow path valves further comprises sequentially closing the water supply valve at a third point in time and the one of the plurality of flow path valves at a fourth in time to stop the supplying of the water.

DETAILED DESCRIPTION

Figure 1:
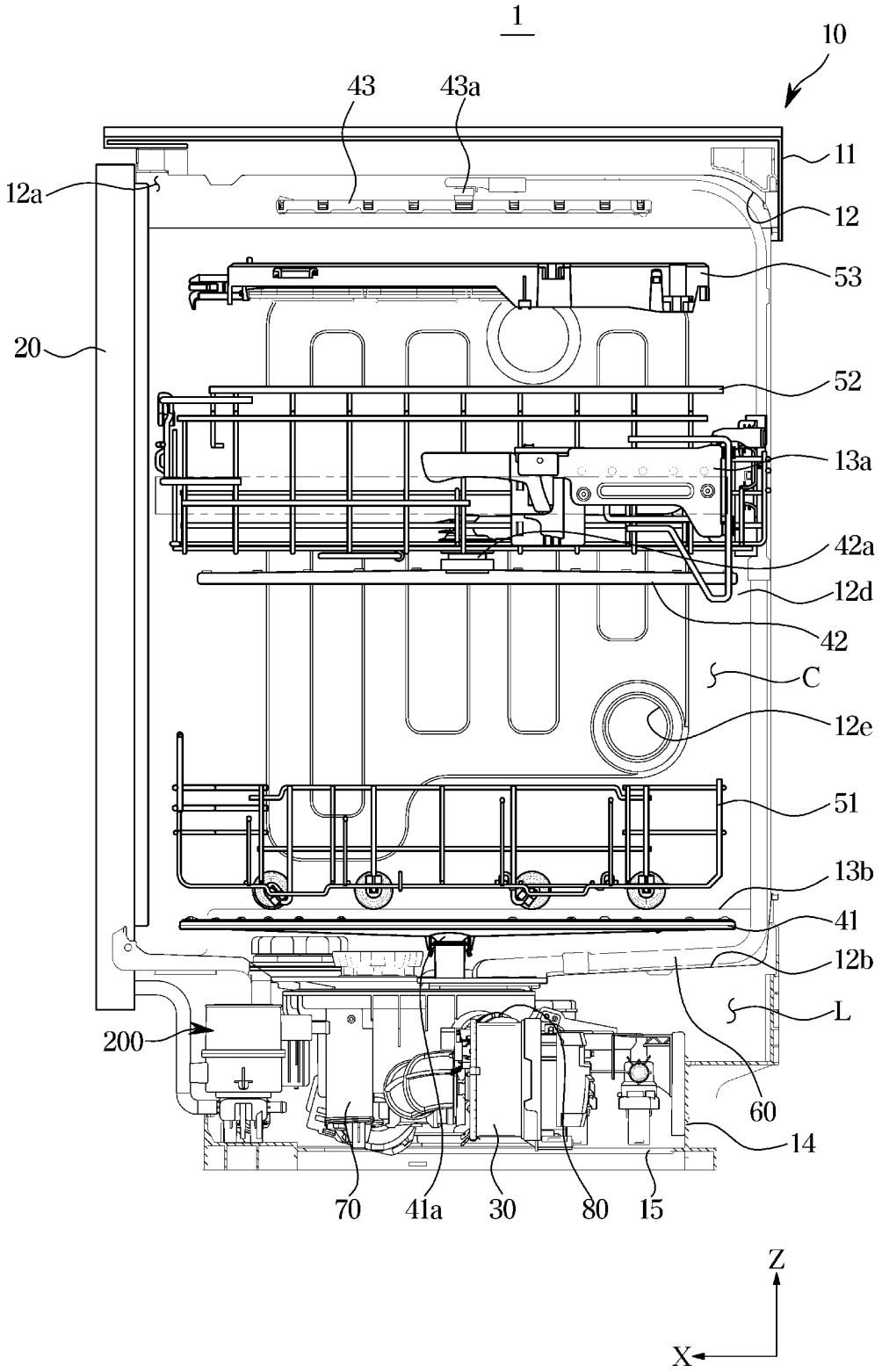
FIG. 1 is a side cross-sectional view of a dish washer, according to an embodiment.

Embodiments and features as described and illustrated in the disclosure are merely examples, and there may be various modifications replacing the embodiments and drawings at the time of filing this application.

Throughout the drawings, like reference numerals refer to like parts or components. For the sake of clarity, the elements of the drawings are drawn with exaggerated forms and sizes.

It will be further understood that the term "connect" or its derivatives refer both to direct and indirect connection, and the indirect connection includes a connection over a wireless communication network.

The terminology used herein is for the purpose of describing particular embodiments only and is not intended to limit the present disclosure. It is to be understood that the singular forms "a," "'an," and "the" include plural references unless the context clearly dictates otherwise. It will be further understood that the terms "comprise" and/or "comprising," when used in this specification, specify the presence of stated features, integers, steps, operations, elements, and/or components, but do not preclude the presence or addition of one or more other features, integers, steps, operations, elements, components, and/or groups thereof.

The terms including ordinal numbers like "first" and "second" may be used to explain various components, but the components are not limited by the terms. The terms are only for the purpose of distinguishing a component from another. Thus, a first element, component, region, layer or room discussed below could be termed a second element, component, region, layer or section without departing from the teachings of the disclosure. Descriptions shall be understood as to include any and all combinations of one or more of the associated listed items when the items are described by using the conjunctive term "~and/or~," or the like.

Furthermore, the terms, such as "~part", "~block", "~member", "~module", etc., may refer to a unit of handling at least one function or operation. For example, the terms may refer to at least one process handled by hardware such as field-programmable gate array (FPGA)/application specific integrated circuit (ASIC), etc., software stored in a memory, or at least one processor.

Reference numerals used for method steps are just used to identify the respective steps, but not to limit an order of the steps. Thus, unless the context clearly dictates otherwise, the written order may also be practiced otherwise.

Embodiments of the disclosure will now be described with reference to the accompanying drawings.

Figure 2:
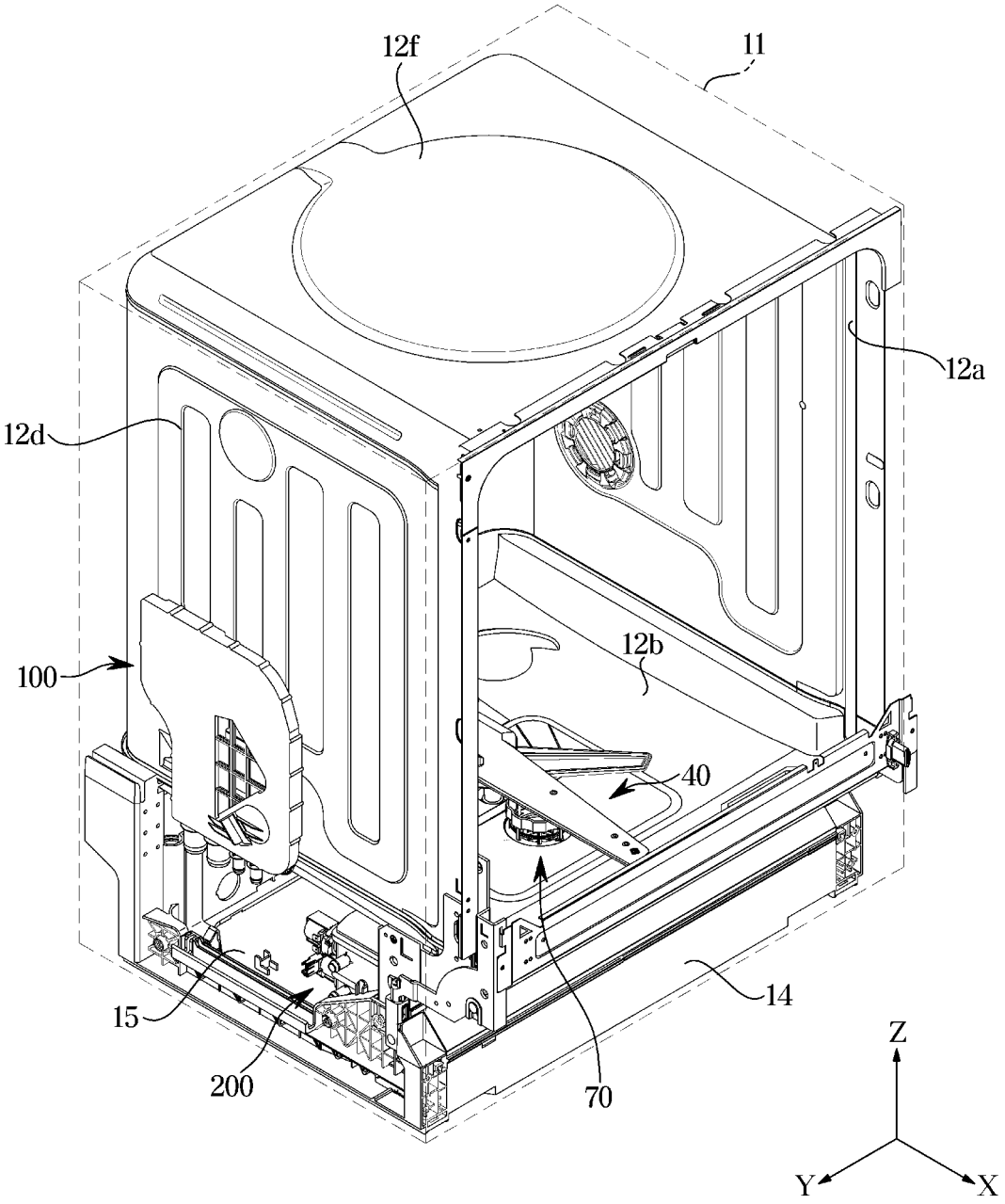
FIG. 2 illustrates a case brake coupled to one side of a tub of a dish washer, according to an embodiment.

FIG. 1 is a side cross-sectional view of a dish washer, according to an embodiment. FIG. 2 illustrates a case brake coupled to one side of a tub of a dish washer, according to an embodiment.

Referring to FIGS. 1 and 2, the dish washer 1 may include a main body 10 that defines an exterior of the dish washer 1. The main body 10 may include a cabinet 11 that defines the exterior of the dish washer and a tub 12 arranged in the cabinet 11. The tub 12 may be shaped substantially like a box. One side of the tub 12 may be opened. That is, the tub 12 may include an open portion 12*a*. For example, the front side of the tub 12 may be opened.

The dish washer 1 may further include a door 20 arranged to open or close the open portion 12*a* of the tub 12. The door 20 may be installed on the main body 10 to open or close the open portion 12*a* of the tub 12. The door 20 may be installed at the cabinet 11 to be pivotable.

The dish washer 1 may further include a storage container provided in the tub 12 to receive dishes. The storage container may include a plurality of baskets 51, 52 and 53. Dishes having relatively large volume may be received in the plurality of baskets 51, 52 and 53. However, the types of the dishes to be received in the plurality of baskets 51, 52 and 53 are not limited to the dishes having relatively large volume. That is, not only the dishes having relatively large volume but also dishes having relatively small volume may be received in the plurality of baskets 51, 52 and 53.

The plurality of baskets 51, 52 and 53 may include a middle basket 52 located in the middle in a direction of the height of the dish washer 1 and a lower basket 51 located in a lower portion in the direction of the height of the dish washer 1. The middle basket 52 may be arranged to be supported on a middle guide rack 13*a*, and the lower basket 51 may be arranged to be supported on a lower guide rack 13*b*. The middle guide rack 13*a* and the lower guide rack 13*b* may be installed on the inner side of a side wall 12*d* of the tub 12 to be slidable toward the open portion 12*a* of the tub 12.

The plurality of baskets 51, 52 and 53 may include an upper basket 53 located in an upper portion in the direction of height of the dish washer 1. The upper basket 53 may be formed in the shape of a rack assembly to receive dishes having relatively small volume. It may be desirable to use the upper basket 53 to receive cooking tools or cutleries such as dippers, knives, turners, etc. Small cups such as espresso cups may also be received in the rack assembly. However, the types of dishes to be received in the upper basket 53 are not limited thereto.

The dish washer 1 may further include a sump 70 for storing water for washing. The dish washer 1 may include a washing chamber C, a space formed by insides of the tub 12. The washing chamber C is a room where the dishes contained in the baskets 51, 52 and 53 may be washed and dried. The washing chamber C may be defined as an inside space of the tub 12 formed by a top wall 12*f*, side walls 12*d*, a front wall (not shown), a rear wall 12*c*, a bottom 12*b*, and the sump 70 linked to the bottom 12*b*.

The dish washer 1 may further include spraying units 41, 42 and 43 provided to spray water for washing. The spraying units 41, 42 and 43 may include a first spraying unit 41 arranged under the lower basket 51 in the direction of height of the dish washer 1, a second spraying unit 42 arranged under the middle basket 52 in the direction of height of the dish washer 1, and a third spraying unit 43 arranged above the upper basket 53 in the direction of height of the dish washer 1.

The first spraying unit 41 may be arranged to be rotatable on a first rotation axis 41*a*, the second spraying unit 42 may be arranged to be rotatable on a second rotation axis 42*a*, and the third spraying unit 43 may be arranged to be rotatable on a third rotation axis 43*a*.

It is not, however, limited to the embodiment of the disclosure, and the first spraying unit 41 may be arranged to be fixed on a side of the bottom 12*b* unlike the second spraying unit 42 and the third spraying unit 43. In this case, the first spraying unit 41 may be provided to substantially horizontally spray water for washing through a fixed nozzle, and the water for washing sprayed horizontally from the nozzle of the first spraying unit 41 may be turned in another direction by a switching assembly (not shown) arranged in the washing chamber C to move upward.

The third spraying unit 43 may spray the water for washing toward the dishes received in the upper basket 53, the middle basket 52 and the lower basket 51, and the second spraying unit 52 may spray the water for washing toward the dishes received in the middle basket 52 and the upper basket 53. The first spraying unit 41 may be coupled to the tub bottom 12*b* unlike the second spraying unit 42 and the third spraying unit 43. Specifically, the first spraying unit 41 may be arranged to be fixed to the sump 70.

The dish washer 1 may include a circulation pump 30 for pumping water stored in the sump 70 into the spraying units 41, 42 and 43. The water for washing pumped by the circulation pump 30 may be supplied into the first spraying unit 41 through an alternator 80 connected to the circulation pump 30 or may be moved upward by a duct 60 and supplied into the second spraying unit 42 or the third spraying unit 43.

As described above, the water for washing stored in the sump 70 or water for washing brought into the dish washer 1 from outside may be moved to the alternator 80 by the circulation pump 30. The alternator 80 may provide the water for washing to the first spraying unit 41 through a connector (not shown) connected to the first spraying unit 41, and provide the water for washing to the duct 60 through a flow path connected to the duct 60.

The alternator 80 may selectively provide the water for washing to at least one of the connector and the duct 60. The alternator 80 may be arranged in a machine room L arranged under the washing chamber C.

The dish washer 1 may include the machine room L arranged under the tub 12. The machine room L may be formed by a lower frame 14 and a bottom plate 15. In the machine room L, components such as the circulation pump 30, the sump 70, the alternator 80, etc., may be placed and a water supply hose and a drain hose, which will be described later, may be placed.

The dish washer 1 may include a case brake 100 coupled onto the side wall 12*d* of the tub 12. For example, the case brake 100 may be coupled onto an outer wall of the tub. The case brake 100 may be arranged in a lower portion of the outer wall of the tub 12. The case brake 100 may receive water from a filter assembly 200. The case brake 100 may lead water to the sump 70. In FIG. 2, a hose that connects the case brake 100, the sump 70 and/or the filter assembly 200 are not shown.

The case brake 100 is provided to be connected to a link hole 12*e* formed on the side wall 12*d* of the tub 12. For example, a tub link hole 113 of the case brake 100 and the link hole 12*e* of the tub may be linked to each other.

The case brake 100 includes a case 110. The case 110 may be coupled to the side wall 12*d* of the tub 12. The case 110 may include the tub link hole 113 formed at a second case 112 for the case brake 100 to be coupled to the side wall 12*d* of the tub 12. The tub link hole 113 may be coupled to an outer wall of the tub 12 by a coupling member (not shown) coupled to an inner wall of the tub 12.

The dish washer 1 may include the filter assembly 200 for filtering water to be supplied to the sump 70 from the outside. The filter assembly 200 may receive water from the outside. The filter assembly 200 is arranged upstream of the case brake 100 to enable purified water to flow to the case brake 100. The filter assembly 200 may be placed underneath the tub 12.

The filter assembly 200 may be arranged in the machine room L. For example, part of the filter assembly 200 may be arranged underneath the tub bottom 12*b*. The filter assembly 200 may be accommodated in the cabinet 11. Hence, the filter assembly 200 may not be exposed to the outside unless the door 20 is opened. However, part of the filter assembly 200 may go through the tub bottom 12*b* to be exposed to the inside of the washing chamber C.

The user may replace a filter in the filter assembly 200 by opening the washing chamber C. For example, part of the filter assembly 200 may be arranged underneath the tub 12, and the other part of the filter assembly 200 may go through the tub bottom 12*b* to be arranged in the washing chamber C. To replace the filter, the user may open the washing chamber C, separate a case cover 230 of the filter assembly 200, and replace a filter 220 accommodated in the filter assembly 200.

As the filter assembly 200 is arranged in the cabinet 11, even when there is a water leak from the filter assembly 200, the water may not leak out of the cabinet 11. Accordingly, furniture around the dish washer 1 may not be damaged. Furthermore, there may be a water leak sensor 320 on the bottom plate 15, and a notification of water leak may be provided through a user interface 310 when there is a water leak from the filter assembly 200.

Figure 3:
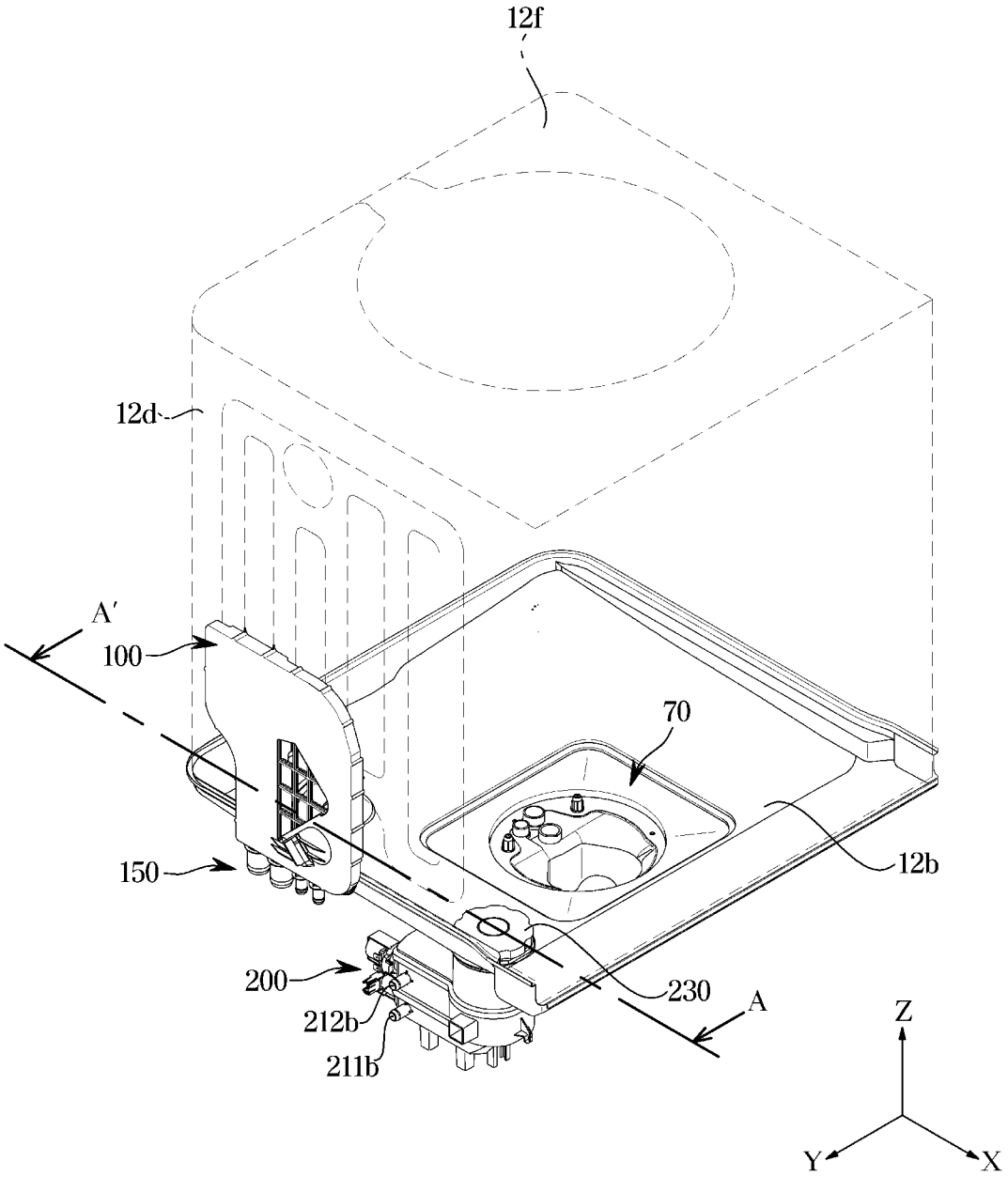
FIG. 3 is a perspective view illustrating some components of a dish washer, according to an embodiment.
Figure 4:
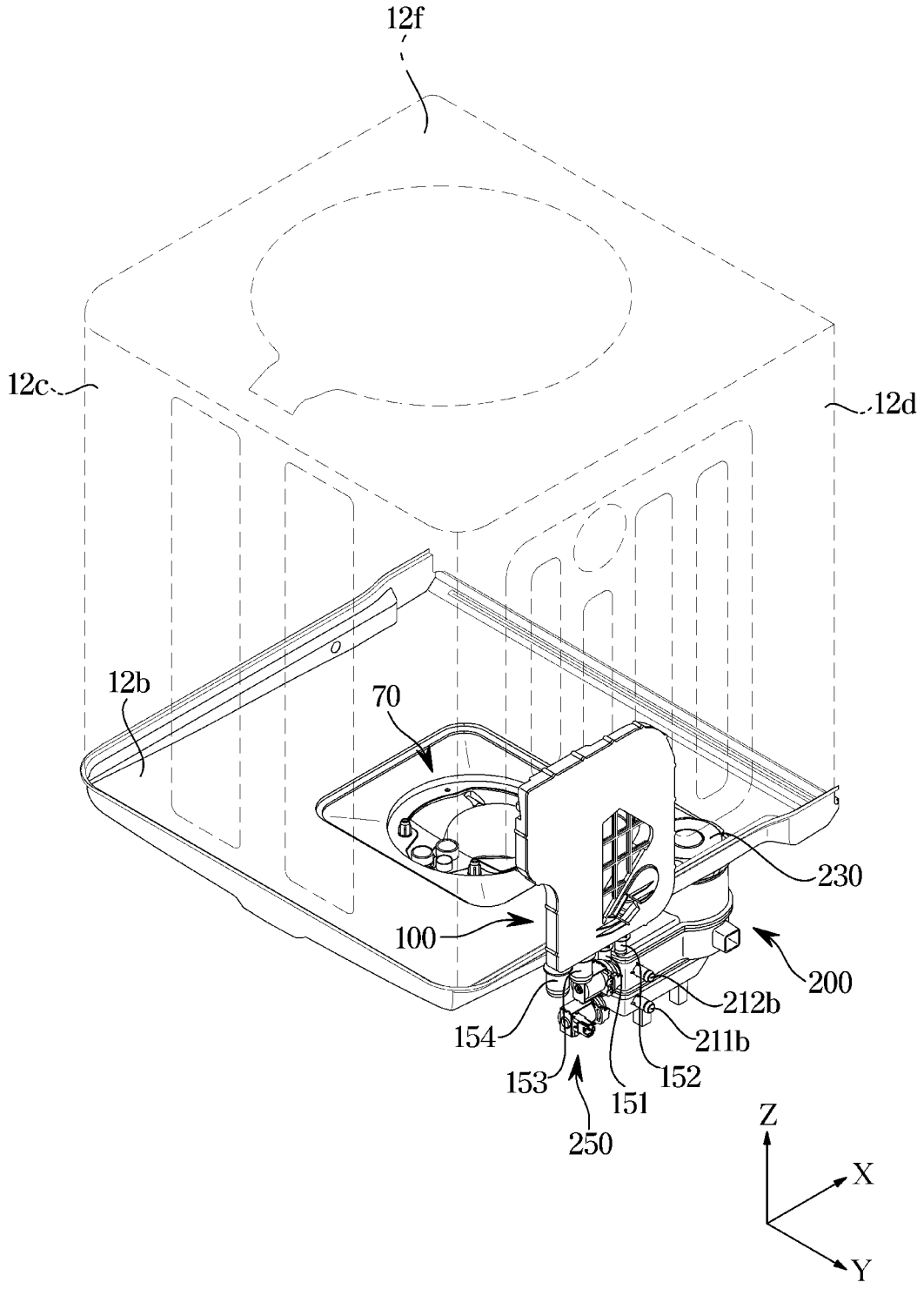
FIG. 4 is a perspective view illustrating the dish washer of FIG. 3 viewed from a different angle.
Figure 5:
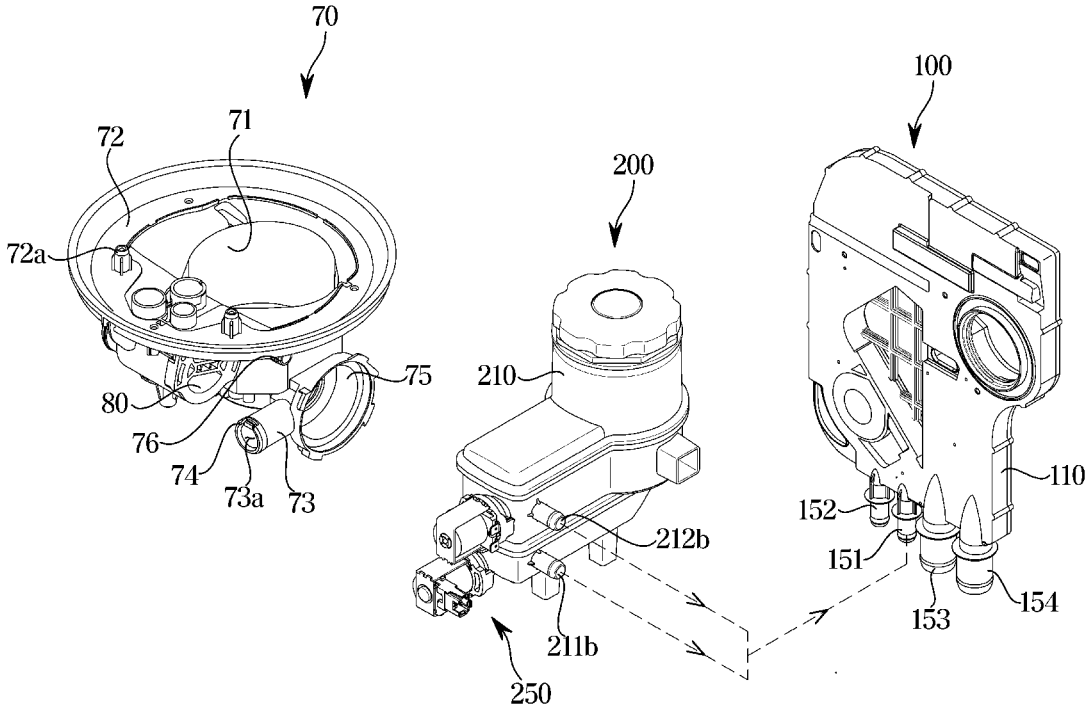
FIG. 5 illustrates a sump, a case brake and a filter assembly of a dish washer, according to an embodiment.

FIG. 3 is a perspective view illustrating some components of a dish washer, according to an embodiment. FIG. 4 is a perspective view illustrating the dish washer of FIG. 3 viewed from a different angle. FIG. 5 illustrates a sump, a case brake and a filter assembly of a dish washer, according to an embodiment.

The case brake 100, the sump 70 and/or the filter assembly 200 are connected by a hose, but the hose is not shown in the drawings to clearly illustrate structural features. In FIG. 5, the case brake 100 is rotated at 90 degrees from the sump 70 and the filter assembly 200.

Referring to FIGS. 3 and 4, the dish washer 1 may include the tub 12, the sump 70, the case brake 100 and the filter assembly 200. The filter assembly 200 may be arranged in the cabinet 11. The filter assembly 200 may be arranged in the machine room L. The filter assembly 200 may be arranged underneath the tub bottom 12*b*. However, part of the filter assembly 200 may be exposed to the inside of the washing chamber C from the tub bottom 12*b*.

The filter assembly 200 may include an inflow tube 211*a*, outflow tubes 211*b* and 212*b*, and a flow path valve 250. The inflow tube 211*a* may be connected to a water supply source 400 outside the dish washer 1. Water may be supplied to the filter assembly 200 from the water supply source 400 through the inflow tube 211*a*. The water supply source 400 may be connected and coupled to a water supply valve 410. In response to opening or closing the water supply valve 410, inflow of water to the dish washer 1 from the water supply source 400 may be allowed or blocked. When the water supply valve 410 is opened, water may flow into the filter assembly 200 through the inflow tube 211*a*.

The outflow tubes 211*b* and 212*b* may enable the water that has passed through the filter assembly 200 to flow to the case brake 100. The outflow tubes 211*b* and 212*b* may be connected through the inflow tube 151 of the case brake 100 and an inflow hose 151*a*. The outflow tubes 211*b* and 212*b* may be provided in the plural. The outflow tubes 211*b* and 212*b* may include the first outflow tube 211*b* and the second outflow tube 212*b*. The first outflow tube 211*b* and the second outflow tube 212*b* may be connected to the inflow tube 151 of the case brake 100.

The flow path valve 250 may be formed between the water supply valve 410 and the case brake 100 to open or close a flow path that leads water to the case brake 100. The flow path valve 250 may open or close each of a flow path in which water brought into the filter assembly 200 passes through the filter 220 and a flow path in which the water bypasses the filter 220. The flow path valve 250 may include a solenoid valve and/or a thermo actuator 250. The type of the flow path valve 250 is not, however, limited to the example, and various other types of valves may be used. For example, the flow path valve 250 may include a three-way valve or a four-way valve.

The flow path valve 250 may be provided in the plural. The plurality of flow path valves 250 may include a first flow path valve 251 and a second flow path valve 252. When the first flow path valve 251 is opened, the water that has been filtered in the filter assembly 200 may flow to the case brake 100 through the first outflow tube 211*b*. When the second flow path valve 252 is opened, the water that has not been filtered in the filter assembly 200 but bypassed the filter 220 may flow to the case brake 100 through the second outflow tube 212*b*. The first flow path valve 251 may be referred to as a filtering flow path valve 251. The second flow path valve 252 may be referred to as a bypass flow path valve 252.

When water supply into the dish washer 1 is not required, both the bypass flow path and the filtering flow path may remain closed. In other words, in a case that water supply into the dish washer 1 is not required, both the first flow path valve 251 and the second flow path valve 252 may be kept closed. A processor 520 of the dish washer 1 may selectively open the first flow path valve 251 and the second flow path valve 252 when water supply into the dish washer 1 is required. Depending on whether purified water is required to be supplied, one of the first flow path valve 251 and the second flow path valve 252 may be opened while the other may be kept closed.

Referring to FIG. 5, the sump 70 may include a water collector 71, a seat 72, a drain tube 73, a check valve 74, a drain pump coupler 75, and a sump inflow tube 76. The water collector 71 may collect water that has sequentially passed the filter assembly 200 and the case brake 100. The water collector 71 may be opened to collect water. The water collector 71 may be an opening of the sump 70. The tub bottom 12*b* may be seated on the seat 72. The tub 12 may be coupled to the sump 70. For example, the tub bottom 12*b* may be penetrated by and coupled to a coupling projection 72*a* formed at the seat 72.

The drain tube 73 may be provided to drain water collected in the water collector 71. The drain tube 73 may allow water to flow into a sump drain connection tube 153 of the case brake 100 through a drain hole 73*a*. The water brought into the case brake 100 through the sump drain connection tube 153 may drain to the outside through a drain hose connection tube 154.

The drain tube 73 may be coupled to the check valve 74. The check valve 74 may prevent the water from flowing backward. The check valve 74 may be coupled to an end of the drain tube 73.

The sump inflow tube 76 may allow the water that has sequentially passed the filter assembly 200 and the case brake 100 to be collected in the sump 12. The sump inflow tube 76 may be connected to an extra hose 152*a* connected to the outflow tube 152 of the case brake 100. Accordingly, the water in the case brake 100 may be connected to the sump 70 through the sump inflow tube 76 and collected in the water collector 71. The drain pump coupler 75 may be coupled to a drain pump (not shown) that pumps water so that the water collected after a washing process drains.

The case brake 100 may include the case 110 and tubes 150 arranged in a lower portion of the case. Water to be supplied to the sump 70 and water draining from the sump 70 may flow in the case 110 through the tubes 150. In FIG. 5, the case brake 100 is rotated at 90 degrees from the sump 70 and the filter assembly 200.

The case brake 100 includes the case 110. The case 110 may be coupled to the side wall 12*d* of the tub 12. The case 110 may include the tub link hole 113 formed at the second case 112 for the case brake 100 to be coupled to the side wall 12*d* of the tub 12. The tub link hole 113 may be coupled to the outer wall of the tub 12 by the coupling member (not shown) coupled to the inner wall of the tub 12 (see FIGS. 2 and 3).

Figure 6:
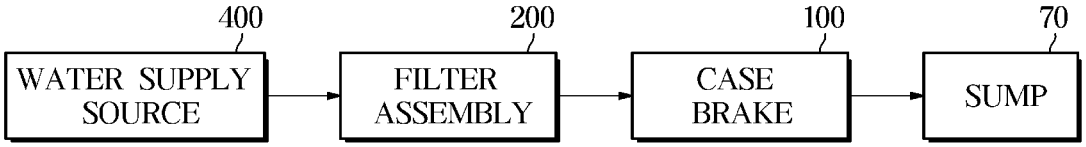
FIG. 6 is a block diagram illustrating a flow of water in a dish washer, according to an embodiment.

FIG. 6 is a block diagram illustrating a flow of water in a dish washer, according to an embodiment.

Referring to FIG. 6, water may flow into the filter assembly 200 through the water supply source 400 outside the dish washer 1. The filter assembly 200 may purify the water brought in and lead the purified water to the case brake 100 or lead the original water brought in to the case brake 100. The filter assembly 200 may include the filter 220, and water may be filtered by the filter 220.

The water supply source 400 may supply water into the inflow tube 211*a* of the filter assembly 200. The water may flow into the filter assembly 200 through the inflow tube 211*a* of the filter assembly 200 from the water supply source 400. In response to opening or closing the water supply valve 410, inflow of the water to the filter assembly 200 from the water supply source 400 may be allowed or blocked.

The case brake 100 may be arranged in a higher position than the filter assembly 200. For example, an inlet 121 of the case brake 100 may be arranged in a higher position than outlets 240*b* and 240*c* of the filter assembly 200. Even though the filter assembly 200 is in a lower position than the case brake 100, the water that has passed the filter assembly 200 may flow into the case 110 of the case brake 100 through the inlet 121 of the case brake 100 due to pressure of the water supplied from the water supply source 400.

The water that has passed the case brake 100 may flow into the sump 70. The water flowing into the sump 70 may flow into a spraying unit 40 through the alternator 80. Specifically, the water supplied from the outside may flow to the filter assembly 200, the case brake 100, and the sump 70 in sequence.

The bottommost portion of the case brake 100 may be in a higher position than the water collector 71 of the sump 70. For example, an outlet 122 formed at a bottom of the case brake 100 and lower ends of the tubes 150 arranged at the bottom may be in higher positions than the highest position of the water collector 71. Potential energy of the water in the case brake 100 is greater than potential energy of water in the sump 70, so the water collected in the sump 70 may not flow backward to the case brake 100.

Figure 7:
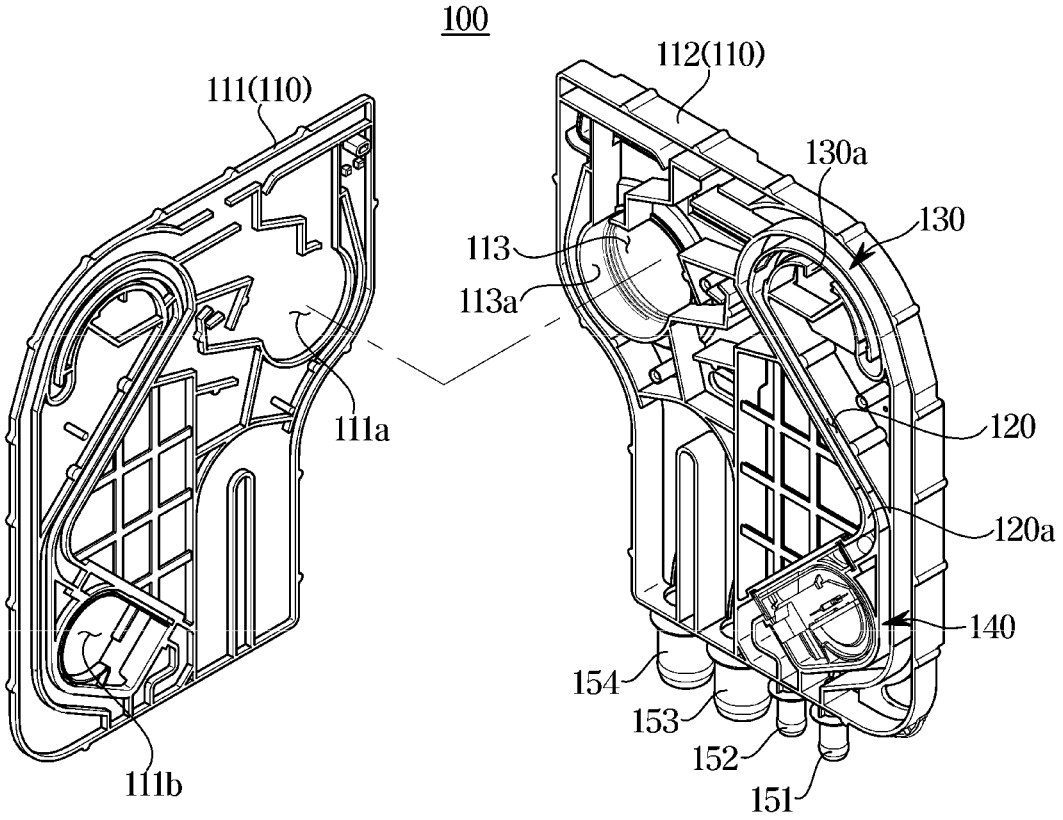
FIG. 7 is an exploded perspective view of a case of a case brake, according to an embodiment.
Figure 8:
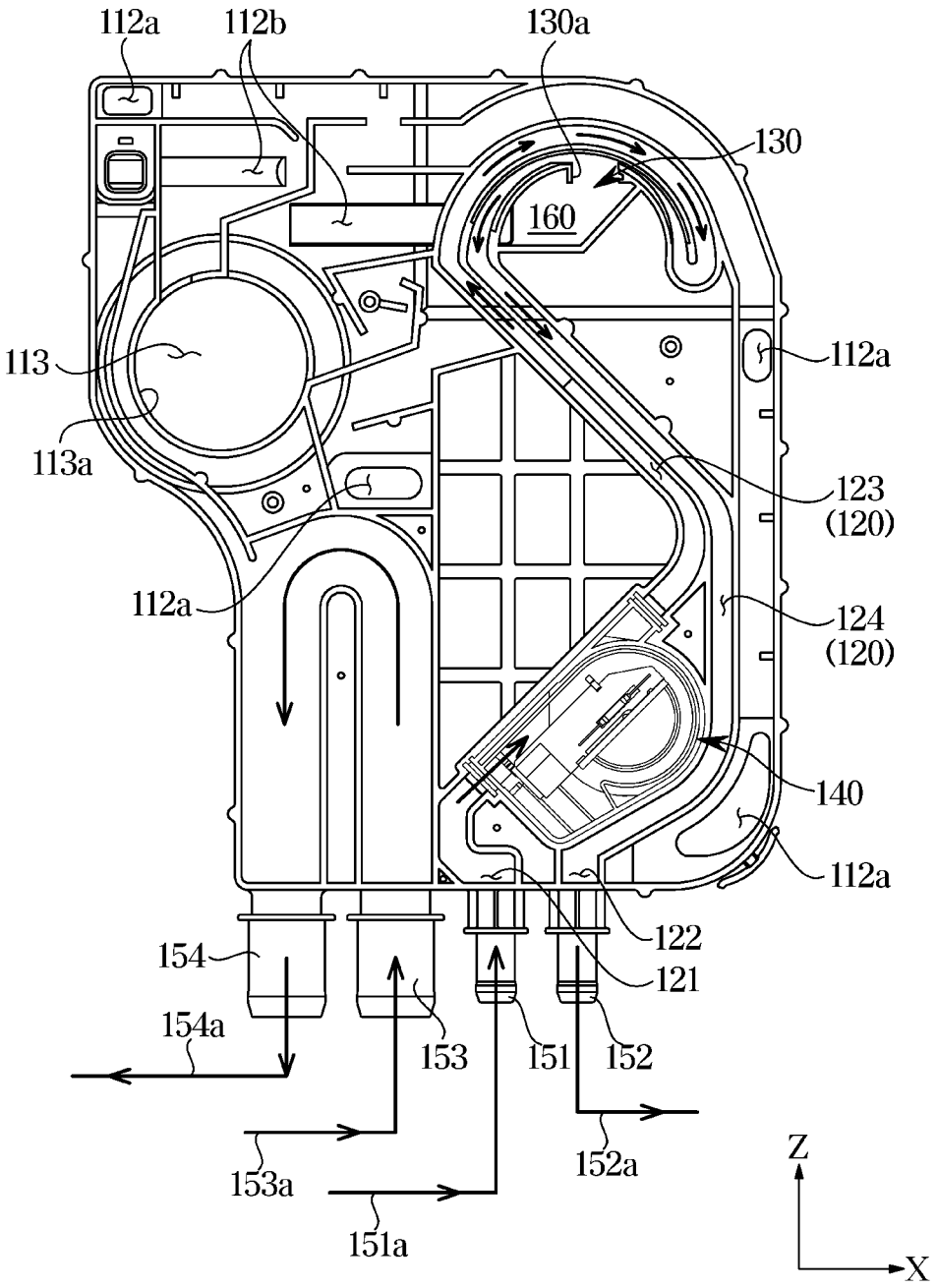
FIG. 8 is a plan view of a second case of the case brake shown in FIG. 7.

FIG. 7 is an exploded perspective view of a case of a case brake, according to an embodiment. FIG. 8 is a plan view of a second case of the case brake shown in FIG. 7.

Referring to FIGS. 7 and 8, a dish washer according to an embodiment of the disclosure may include the case brake 100. The case brake 100 may include the case 110, an internal flow path 120, an air brake 130, a flowmeter 140, and the plurality of tubes 150.

The case 110 may include a first case 111 and the second case 112. The first case 111 may include a tub link hole cover 111*a* that covers the tub link hole 113 formed in the second case 112, and a flowmeter cover 111*b* that covers the flowmeter 140 seated in the second case 112. The first case 111 may become a cover.

The tub link hole cover 111*a* may be arranged in a position corresponding to the tub link hole 113 when the first case 111 and the second case 112 are coupled together. The flowmeter cover 111*b* may be arranged in a position corresponding to the position of the flowmeter 140 when the first case 111 and the second case 112 are coupled together.

The case brake 100 may include an outer link hole 112*a*, an inner link 112*b*, and the tub link hole 113. The outer link hole 112*a*, the inner link 112*b*, and the tub link hole 113 may be formed in the second case 112. The outer link hole 112*a* may maintain pressure balance by forcing air in the case 110 to flow through to the outside of the dish washer. The position in which the outer link hole 112*a* is formed is not limited, and the outer link hole 112*a* may be formed in various positions such as top, bottom, sides, etc., of the second case 112. The inner link 112*b* may be formed in the second case 112 for the air in the case 110 to flow through. The inner link 112*b* may be linked to the tub link hole 113 and/or the outer link hole 112*a*. The tub link hole 113 may be linked to the tub 12 and the case brake 100. The case brake 100 may be coupled to the side wall 12*d* of the tub through a screw thread (screw groove) of a coupling member (not shown) coupled to a screw groove (screw thread) formed in a tub link hole forming part 113*a* at an inner wall of the tub 12.

The case brake 100 may further include an air brake chamber 160. The air brake chamber 160 may be formed in the second case 112. The air brake chamber 160 may be linked to the air brake 130 and may accommodate water discharged from the air brake hole 130*a*. The air brake chamber 160 may be connected to the inner link 112*b*. The inner link 112*b* may be linked to the outer link hole 112*a* and/or the tub link hole 113, and accordingly, air in the case 110 and/or internal flow path 120 may have pressure balance.

The internal flow path 120 may be arranged in the case 100. The internal flow path 120 may be formed by flow path forming walls 120*a* formed in the case 100. The internal flow path 120 may include the inlet 121 and the outlet 122. The internal flow path 120 may be formed by flow path forming walls 120*a* in the case 100. The internal flow path 120 may include a first internal flow path 123 and a second internal flow path 124. The first internal flow path 123 may lead water such that the water brought into the case 110 through the inlet 121 flows into the air brake 130. The second internal flow path 124 may lead water such that the water having passed the air brake 130 flows out to the sump 70.

The flowmeter 140 may be provided in the case 110 of the case brake 100. The flowmeter 140 may measure the amount of water having passed the filter assembly 200 and flowing into the case brake 100. The water brought into the internal flow path 120 through the inlet 121 of the case brake 100 from the filter assembly 200 may sequentially pass through the flowmeter 140 and the air brake 130 and may then be supplied to the sump 70 through the outlet 122 of the case brake 100.

As the water having passed the filter assembly 200 is brought into the case brake 100, the flowmeter 140 in the case brake 100 is able to measure the amount of flow of the water that has passed the filter assembly 200. The water is supplied directly to the sump 70 through the case brake 100, so that the same amount of water as the value of water flow measured by the flowmeter 140 may be supplied to the sump 70. In other words, there may be little error between the amount of water flow measured by the flowmeter 140 and the amount of water flow in the sump collector 71.

The flowmeter 140 may transmit an electric signal and/or data corresponding to the measured amount of water flow to a controller 500. The controller 500 may control an amount of water to be collected in the sump 70 or sprayed into the washing chamber C based on the signal and/or data received from the flowmeter 140.

The water that has passed the flowmeter 140 may flow into the air brake 130 arranged in an upper portion of the case brake 100. The air brake 130 may prevent water from flowing backward to the case brake 100 from the sump 70. The water flowing in the internal flow path 120 may have the highest potential energy at the top of the air brake 130. The air brake 130 may include an air brake hole 130*a* with a portion opened. The air brake hole 130*a* may be linked to the inner link 112*b* arranged to be adjacent to the air brake 130. Accordingly, the air brake hole 130*a* may be linked to the outer link hole 112*a* and/or the tub link hole 113 through the air brake chamber 160 and the inner link 112*b*. The air brake hole 130*a* may make the pressure in the case 110 and/or the internal flow path 120 maintain balance with atmospheric pressure.

The plurality of tubes 150 may allow water to flow into or out of the case brake 100. The plurality of tubes 150 may be arranged at the bottom of the case 110. The plurality of tubes 150 may include the inflow tube 151, the outflow tube 152, the sump drain connection tube 153, and the drain hose connection tube 154.

The inflow tube 151 may be provided so that the water that has flowed through the filter assembly 200 flows into the case brake 100. The inflow tube 151 may extend down from the bottom of the case 110. The inflow tube 151 may be connected to the filter assembly 200 through the first hose 151*a* to allow the water to flow into the case 110. The water flowing in through the inflow tube 151 may pass the flowmeter 140. The inflow tube 151 may be referred to as a first tube.

The outflow tube 152 may be arranged for the water that has passed the air brake 130 from the internal flow path 120 of the case brake 100 to flow into the sump 70. The outflow tube 152 may extend down from the bottom of the case 110. The outflow tube 152 may be connected to the sump 70 through the second hose 152*a* to allow the water to be supplied to the water collector 71 of the sump 70. The outflow tube 152 may be referred to as a second tube.

The water discharged from the sump 70 may flow into the sump drain connection tube 153. The sump drain connection tube 153 may extend down from the bottom of the case 110. The sump drain connection tube 153 may be connected to the drain tube 73 of the sump 70 through a third hose 153*a* to allow the water to flow into the case 110 from the sump 70. The sump drain connection tube 153 may be referred to as a third tube.

The drain hose connection tube 154 may allow the water that has flowed into the case 110 to drain out through the sump drain connection tube 153. The drain hose connection tube 154 may extend down from the bottom of the case 110. The drain hose connection tube 154 may be connected to the outside through a fourth hose 154*a*. The drain hose connection tube 154 may be referred to as a fourth tube.

Figure 9:
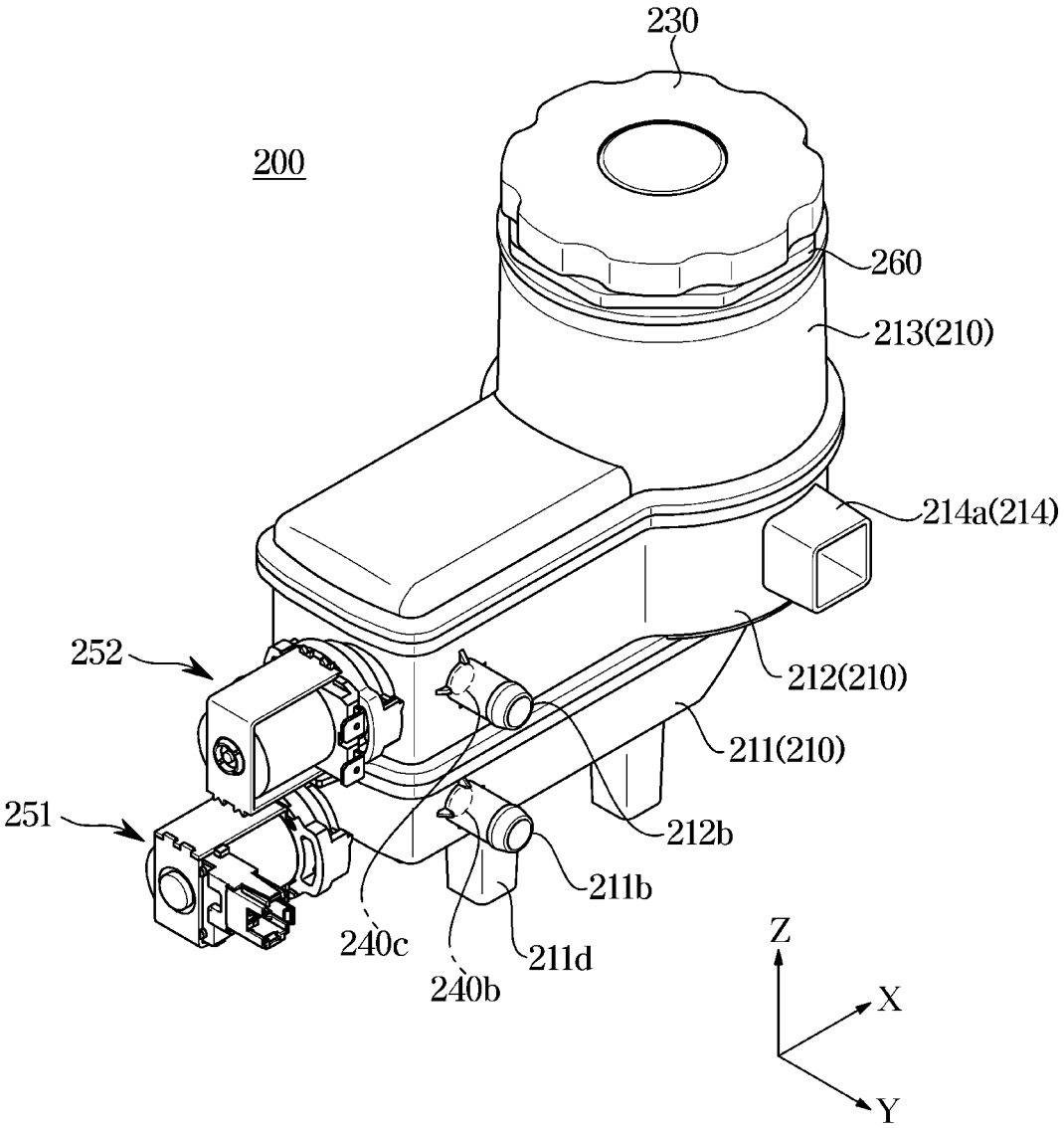
FIG. 9 is a perspective view of a filter assembly, according to an embodiment.
Figure 10:
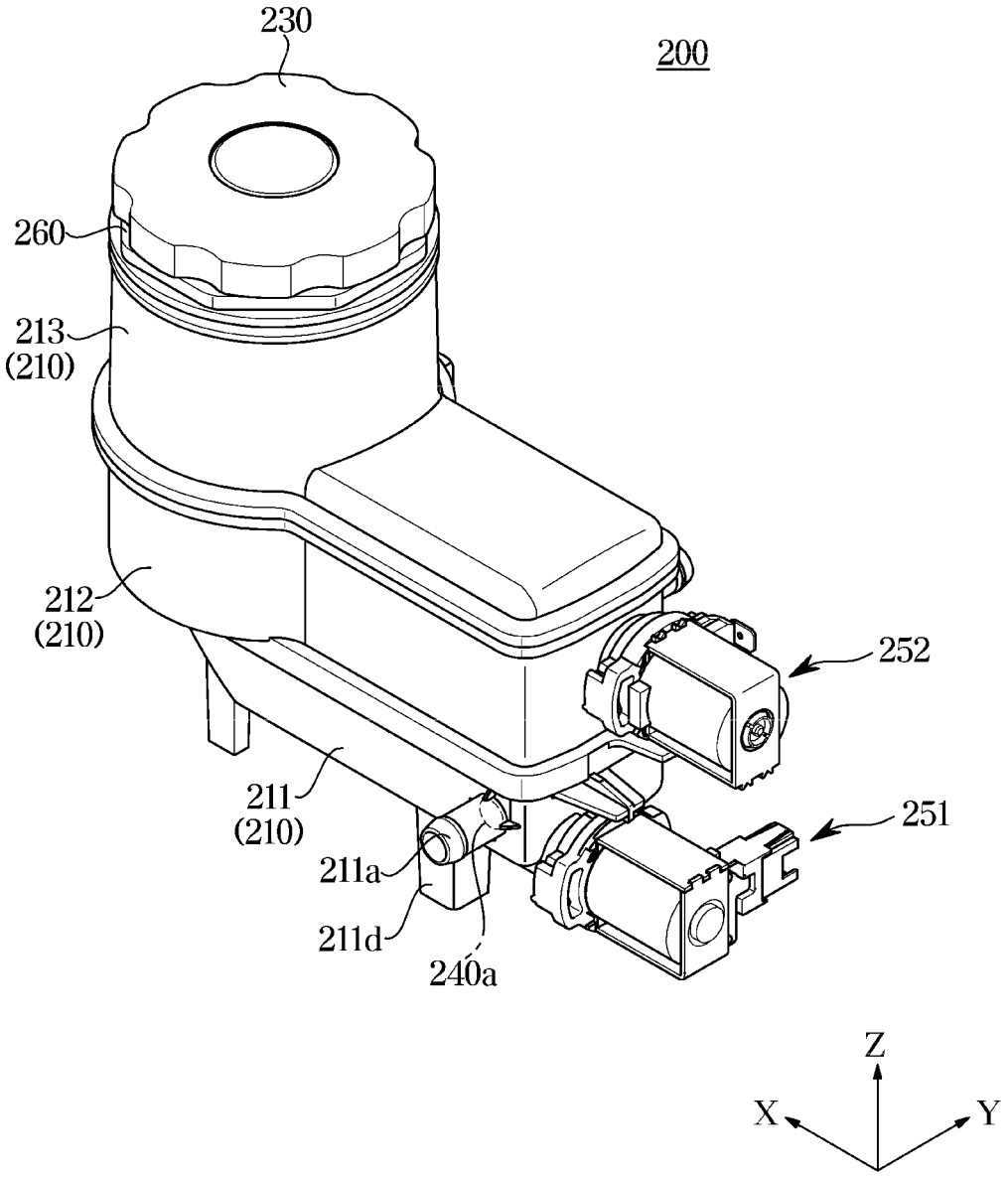
FIG. 10 is a perspective view illustrating the filter assembly shown in FIG. 9 viewed from a different angle.
Figure 11:
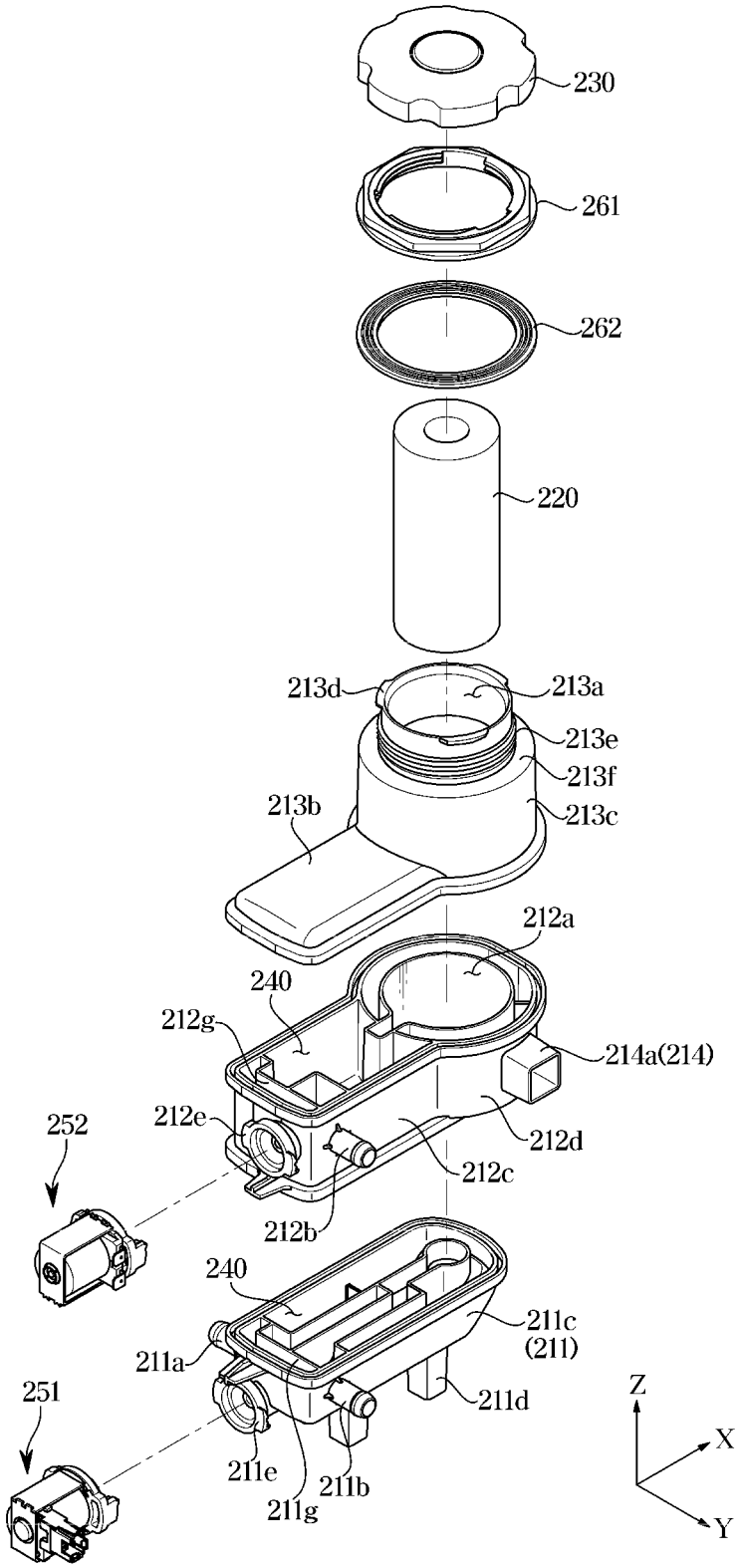
FIG. 11 is an exploded perspective view of a filter assembly, according to an embodiment.

FIG. 9 is a perspective view of a filter assembly, according to an embodiment of the disclosure. FIG. 10 is a perspective view illustrating the filter assembly shown in FIG. 9 viewed from a different angle. FIG. 11 is an exploded perspective view of a filter assembly, according to an embodiment.

Referring to FIGS. 9, 10 and 11, the dish washer 1 may include the filter assembly 200. The filter assembly 200 may include a filter case 210, the filter 220, the case cover 230, the flow path valve 250, and a holder 260.

The filter case 210 may be made up of a first case 211, a second case 212, and a third case 213. The first case 211 may include the inflow tube 211*a*, the first outflow tube 211*b*, a flow path forming part 211*c*, a supporter 211*d*, and a first valve coupler 211*e*. The second case 212 may include the second outflow tube 212*b*, a filter receiver 212*a*, a flow path forming part 212*c*, a receiver cover 212*d* and a second valve coupler 212*e*. The third case 213 may include a filter receiver 213*a*, a flow path cover 213*b*, a receiver cover 213*c* and a coupler 213*d*.

The filter case 210 may be placed underneath the tub 12. For example, part of the filter case 210 may be arranged underneath the tub 12, and the other part of the filter case 210 may go through the tub bottom 12*b* to be arranged in the washing chamber C. The user may separate the case cover 230 coupled to the filter case 210 to replace the filter 220 accommodated in the filter case 210.

The filter case 210 may include the first case 211, the second case 212, and the third case 213. An inner space 240 may be formed in the filter case 210. In the first case 211, the inflow tube 211*a*, the first outflow tube 211*b*, the flow path forming part 211*c*, the supporter 211*d*, and the first valve coupler 211*e* may be formed.

The inflow tube 211*a* may extend in an opposite direction of the Y direction. The inflow tube 211*a* may protrude from an outer surface of the first case 211 facing the sump 70. The inflow tube 211*a* may be arranged to extend toward the sump 70. The inflow tube 211*a* may extend to be connected to the water supply source 400.

The first outflow tube 211*b* may extend in the Y direction. The first outflow tube 211*b* may protrude from an outer surface opposite the surface on which the inflow tube 211*a* is formed in the first case 211. The filter assembly 200 may be arranged such that the first outflow tube 211*b* extends to an inner surface of the cabinet 11. The flow path forming part 211*c* may form outer surfaces of the first case 211. The flow path forming part 211*c* may be a portion in which a flow path is formed in the first case 211. The supporter 211*d* may extend down from the bottom surface of the first case 211. The supporter 211*d* may support the filter assembly 200 by contacting the lower frame 14 and/or the bottom plate 15. It is not, however, limited thereto, and the supporter 211*d* may contact the ground to support the filter assembly 200.

The first valve coupler 211*e* may be formed on one side of the first case 211 to be coupled to the first flow path valve 251. The first valve coupler 211*e* may be formed in the opposite direction of the X direction on the first case 211. When the first flow path valve 251 is coupled to the first valve coupler 211*e*, the first flow path valve 251 may open the filtering flow path to allow the water brought into the filter case 210 to flow to the filter 220.

The second case 212 may include the second outflow tube 212*b*, the filter receiver 212*a*, the flow path forming part 212*c*, the receiver cover 212*d* and the second valve coupler 212*e*. The second outflow tube 212*b* may extend in the direction of Y. The second outflow tube 212*b* may protrude from an outer surface of the second case 212. The second outflow tube 212*b* may be positioned above the first outflow tube 211*b*. The second outflow tube 212*b* may extend to the inner surface of the cabinet 11.

The filter receiver 212*a* of the second case 212 may be opened to receive the filter 220 in the second case 212. Part of the filter 220 may be received in the filter receiver 212*a*. The flow path forming part 212*c* may form at least a portion of the outer surfaces of the second case 212. The flow path forming part 212*c* may be a portion in which a flow path is formed in the second case 212. The receiver cover 212*d* may form at least a portion of the outer surfaces of the second case 212. The receiver cover 212*d* may form the filter receiver 212*a*.

The second valve coupler 212*e* may be formed on one side of the second case 212 to be coupled to the second flow path valve 252. The second valve coupler 212*e* may be formed in the direction of −X on the second case 212. When the second flow path valve 252 is coupled to the second valve coupler 212*e*, the second flow path valve 252 may open the bypass flow path to allow the water brought into the filter case 210 to bypass the filter 220.

Furthermore, a fixer 214 may be arranged on one side of the second case 212. The fixer 214 may be fixed to the lower frame 14 such that the filter case 210 is fixed in the dish washer. The fixer 214 may include a first fixer 214*a* and a second fixer 214*b* (See FIG. 12).

The filter receiver 213*a* of the third case 213 may be opened to receive the filter 220 in the third case 213. Part of the filter 220 may be received in the filter receiver 213*a*. The flow path cover 213*b* may form at least a portion of the top surface of the third case 213. The flow path cover 213*b* may cover the filtering flow path and/or the bypass flow path in the filter case 210. The receiver cover 213*c* may form at least a portion of the outer surfaces of the third case 213. The receiver cover 213*c* may form the filter receiver 213*a*.

The coupler 213*d* of the third case 213 may be detachably coupled to the case cover 230. The coupler 213*d* may be formed at the top of the third case 213. The coupler 213*d* and the case cover 230 may be rotationally coupled. For example, the case cover 230 may be rotated in one direction to be decoupled from or coupled to the coupler 213*d*.

The filter 220 may be arranged in the filter case 210 to filter the water brought into the filter case 210. The filter 220 may be arranged in a flow path in the filter case 210. For example, the filter 220 may be arranged in the filtering flow path. A flow path that does not pass the filter 220 in the filter case 210 may correspond to the bypass flow path.

The flow path valve 250 may be provided to open or close the filtering flow path and/or the bypass flow path. The flow path valve 250 may include various types of valves. For example, the flow path valve 250 may include a solenoid valve. However, the type of the flow path valve 250 is not limited thereto. The flow path valve 250 may include the first flow path valve 251 and the second flow path valve 252.

The first flow path valve 251 and the second flow path valve 252 may be selectively operated under the control of the controller 500. When the filtering flow path is required to be opened, the bypass flow path may be closed, and when the bypass flow path is required to be opened, the filtering flow path may be closed. In other words, when the first flow path valve 251 is opened, the second flow path valve 252 may be closed. When the second flow path valve 252 is opened, the first flow path valve 251 may be closed.

The first flow path valve 251 may be coupled to a side of the first case 211. The first flow path valve 251 may be coupled to the first valve coupler 211*e* formed on the first case 211. The first flow path valve 251 may open or close the filtering flow path. When the first flow path valve 251 opens the filtering flow path, the water in the filter case 210 may flow to the case brake 100 after being filtered through the filter 220.

The second flow path valve 252 may be coupled to a side of the second case 212. The second flow path valve 252 may be coupled to the second valve coupler 212*e* formed on the second case 212. The second flow path valve 252 may open or close the bypass flow path. When the second flow path valve 252 opens the bypass flow path, the water in the filter case 210 may bypass the filter 220 and flow to the case brake 100.

The holder 260 may fix the filter assembly 200 to the tub bottom 12*b* when a portion of the filter case 210 protrudes into the tub 12, and may seal space between the tub bottom 12*b* and the case cover 230. The holder 260 may be coupled to the filter case 210. For example, the holder 260 may be coupled to the third case 213. The holder 260 may cover the circumference of the third case 213. The holder 260 may include a first holder 261 and a second holder 262.

Figure 12:
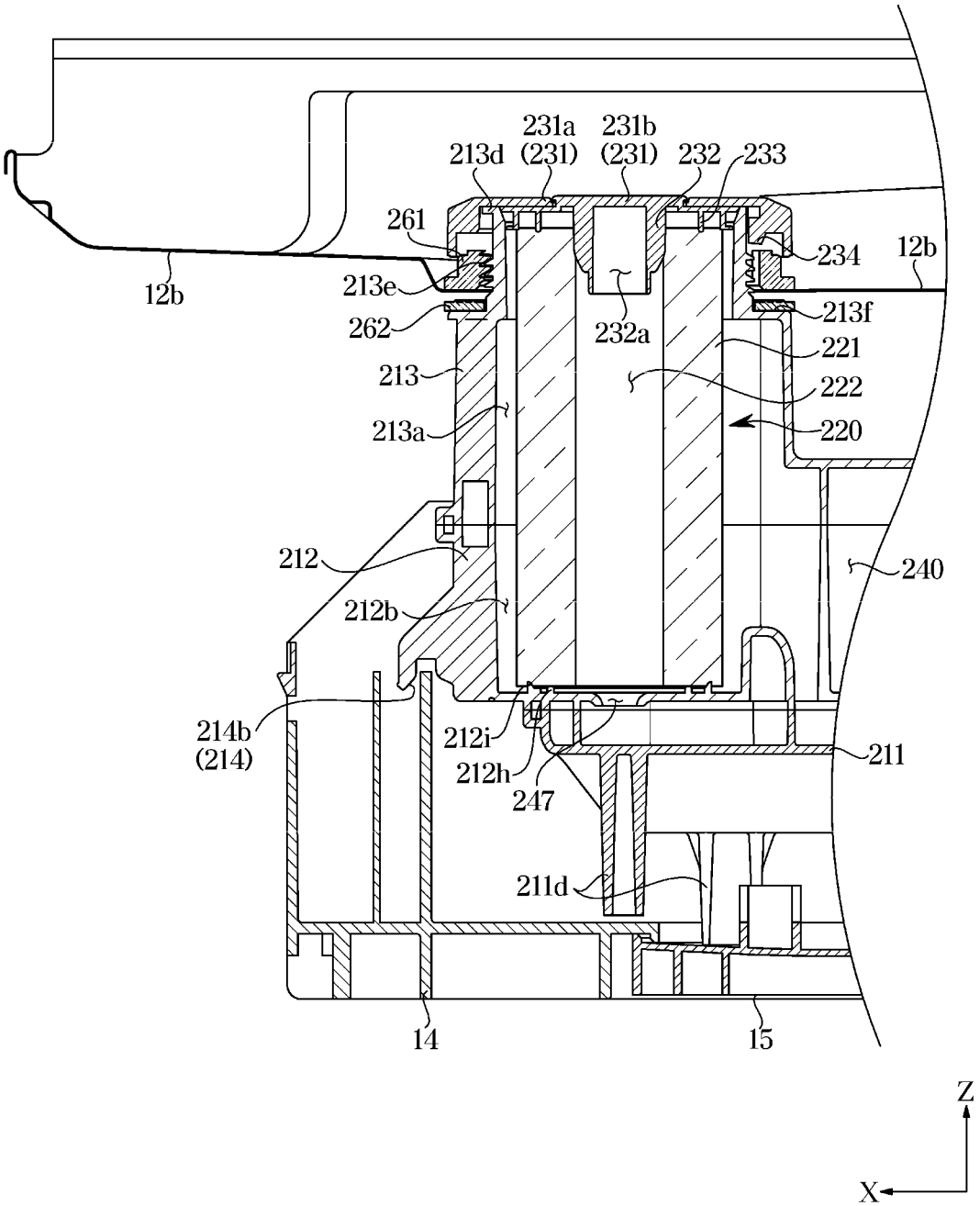
FIG. 12 is a cross-sectional view of the dish washer of FIG. 3 cut along A-A'.

FIG. 12 is a cross-sectional view of the dish washer of FIG. 3 cut along A-A'.

Referring to FIG. 12, the filter assembly 200 of the dish washer 1 may include the filter 220 to be received in the second case 212 and the third case 213. The filter 220 may be arranged in the filter receiver 212*a* of the second case 212 and the filter receiver 213*a* of the third case 213. The filter 220 may include a filter part 221 and a cavity 222. The filter part 221 may filter the water brought into the filter case 210. The cavity 222 may be formed in a center portion of the filter 220.

The filter assembly 200 may include the case cover 230 for covering the top of the filter 220 and/or the filter case 210. The case cover 230 may include a cover part 231, an inserting projection 232, a fixing projection 233, and an interfering rib 234. The cover part 231 may cover the top of the filter 220 and/or the filter case 210. The cover part 231 may include a first cover part 231*a* and a second cover part 231*b*. The first cover part 231*a* may be arranged around the second cover part 231*b*. The inserting projection 232 may be inserted to the cavity 222. The inserting projection 232 may extend down from the cover part 231. The inserting projection 232 may have the filter 220 fixed in the filter case 210. A hole 232*a* may be formed at the inserting projection 232.

The fixing projection 233 is inserted to the filter part 221 so that the filter 220 may be fixed in the filter case 210. The fixing projection 233 may extend down from the cover part 231. The fixing projection 233 may be provided in the plural. When the user attempts to detach the case cover 230 from the filter case 210 to draw out the filter 220 from within the receivers 212*a* and 213*a*, the filter 220 may be detached and/or separated from the filter case 210 along with the case cover 230 while caught in the fixing projection 233. Hence, the user is able to draw out the filter 220 from within the filter case 210 even without taking out the filter 220 with his/her hand, so the convenience increases.

The interfering rib 234 may interfere with the coupler 213*d* of the third case 213. The interfering rib 234 may prevent separation of the filter case 210 and the case cover 230 once the filter case 210 and the case cover 230 are coupled. The interfering rib 234 may be formed to match the coupler 213*d* of the third case 213. The interfering rib 234 may be provided in the plural.

The second case 212 may include a seat 212*h* and a settling projection 212*i*. The filter 220 may be settled in the second case 212. The filter 220 may be safely seated on the seat 212*h* of the second case 212. The seat 212*h* may protrude upward from the bottom of the second case 212. The settling projection 212*i* may be inserted to the inside of the filter part 221. The settling projection 212*i* may also protrude upward from the bottom of the second case 212.

A flow path link hole 247 may be formed at the bottom of the second case 212. The flow path link hole 247 may allow the water having passed the filter 220 along the filtering flow path to flow into a fifth flow path 245. The flow path link hole 247 may be connected to the fifth flow path 245. The flow path link hole 247 may be formed in a position corresponding to the cavity 222 in the vertical direction. The second fixer 214*b* may be arranged on one side of the second case 212. The second fixer 214*b* may have a bending shape. The second fixer 214*b* may make the filter case 210 fixed to the lower frame 14.

The filter assembly 200 may include the holder 260. The holder 260 may be coupled to the third case 213. The holder 260 may cover the circumference of the third case 213. The holder 260 may be provided in the plural. The plurality of holders 260 may include the first holder 261 and the second holder 262.

When the filter case 210 is coupled to the tub bottom 12*b*, the first holder 261 may be placed above the tub bottom 12*b* and the second holder 262 may be placed below the tub bottom 12*b*. The first holder 261 may be coupled to the third case 213 through a screw thread 213*e* of the third case 213. The first holder 261 may fix the filter assembly 200 to the tub bottom 12*b* when a portion of the filter case 210 protrudes into the tub 12, and may seal space between the tub bottom 12*b* and the case cover 230. The second holder 262 may be placed above a surface 213*f* of the third case 213 to be supported by the surface 213*f* of the third case 213.

Figure 13:
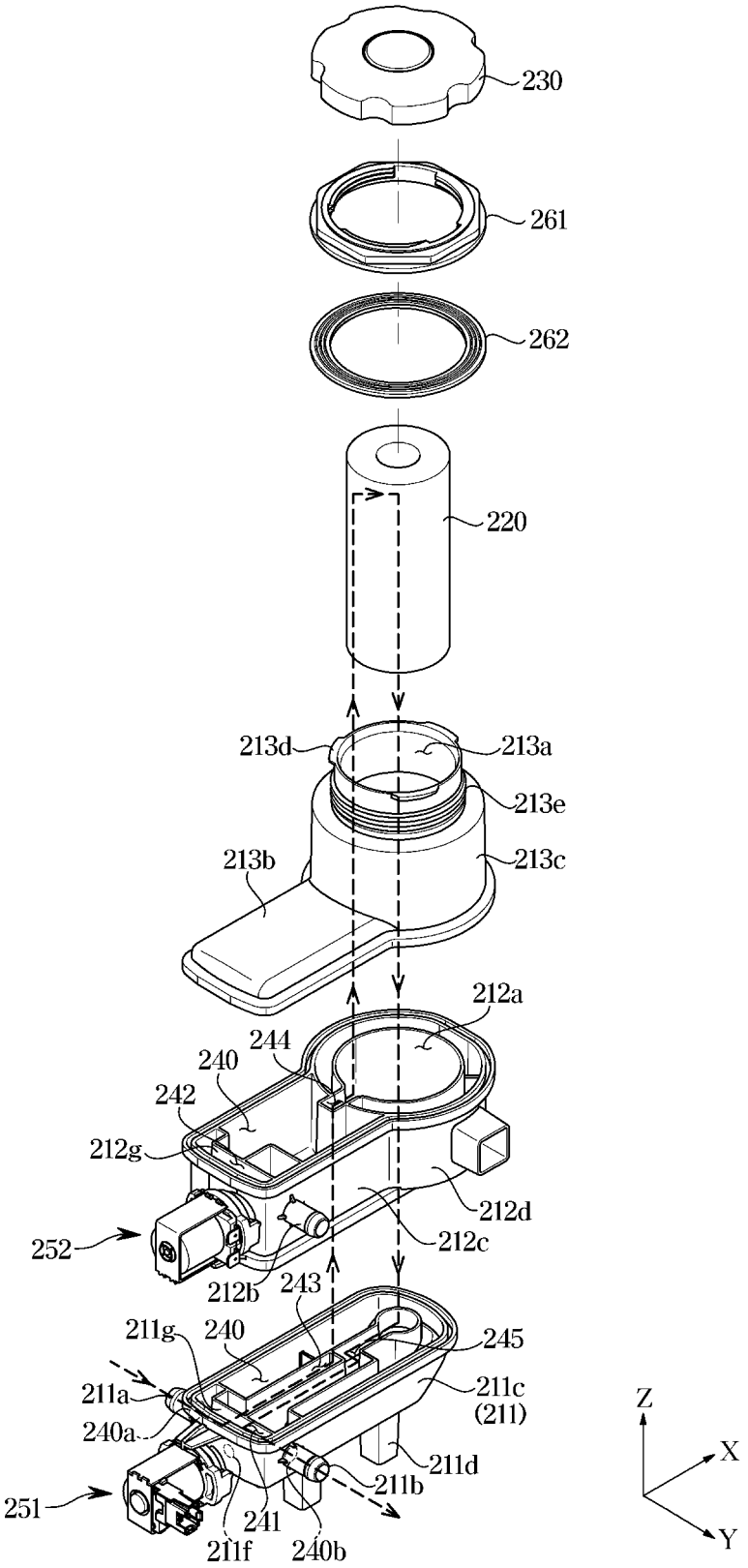
FIG. 13 illustrates a filtering flow path as an example of a flow path formed by a filter assembly.

FIG. 13 illustrates a filtering flow path as an example of a flow path formed by a filter assembly.

Referring to FIG. 13, as the first flow path valve 251 is opened, the filtering flow path is opened and the water brought into the filter case 210 may be filtered. The filtering flow path may be formed by an inlet 240*a*, a first flow path 241, a third flow path 243, a fourth flow path 244, a fifth flow path 245 and the first outlet 240*b*. When the first flow path valve 251 is opened, the second flow path valve 252 may be closed to close the bypass flow path.

Water supplied from the water supply source 400 may flow into the filter assembly 200 through the inflow tube 211*a*. The water having passed the inflow tube 211*a* may flow into the first flow path 241 through the inlet 240*a*. The water brought into the first flow path 241 may flow into a flow path in the first flow path valve 251 and then flow out of the first flow path valve 251. The water having passed the first flow path valve 251 may flow through a hole 211*f* formed at a flow path forming wall 211*g* into the third flow path 243 that extends in the direction of X. The water that has passed the third flow path 243 may flow up into the fourth flow path 244 formed in the second case 212. The water that has passed the fourth flow path 244 may flow to the filter 220. The water flowing to the filter 220 may be filtered and may flow down.

The water that has passed through the filter 220 may flow into the fifth flow path 245 formed in the first case 211. For example, the water that has passed the fourth flow path 244 may flow to the cavity 222 after passing through the filter part 221, and pass the flow path link hole 247 through the cavity 222. The water having passed the flow path link hole 247 may head toward the fifth flow path 245. The water flowing in the fifth flow path 245 may flow into the case brake 100 through the first outlet 240*b* and the first outflow tube 211*b*.

Figure 14:
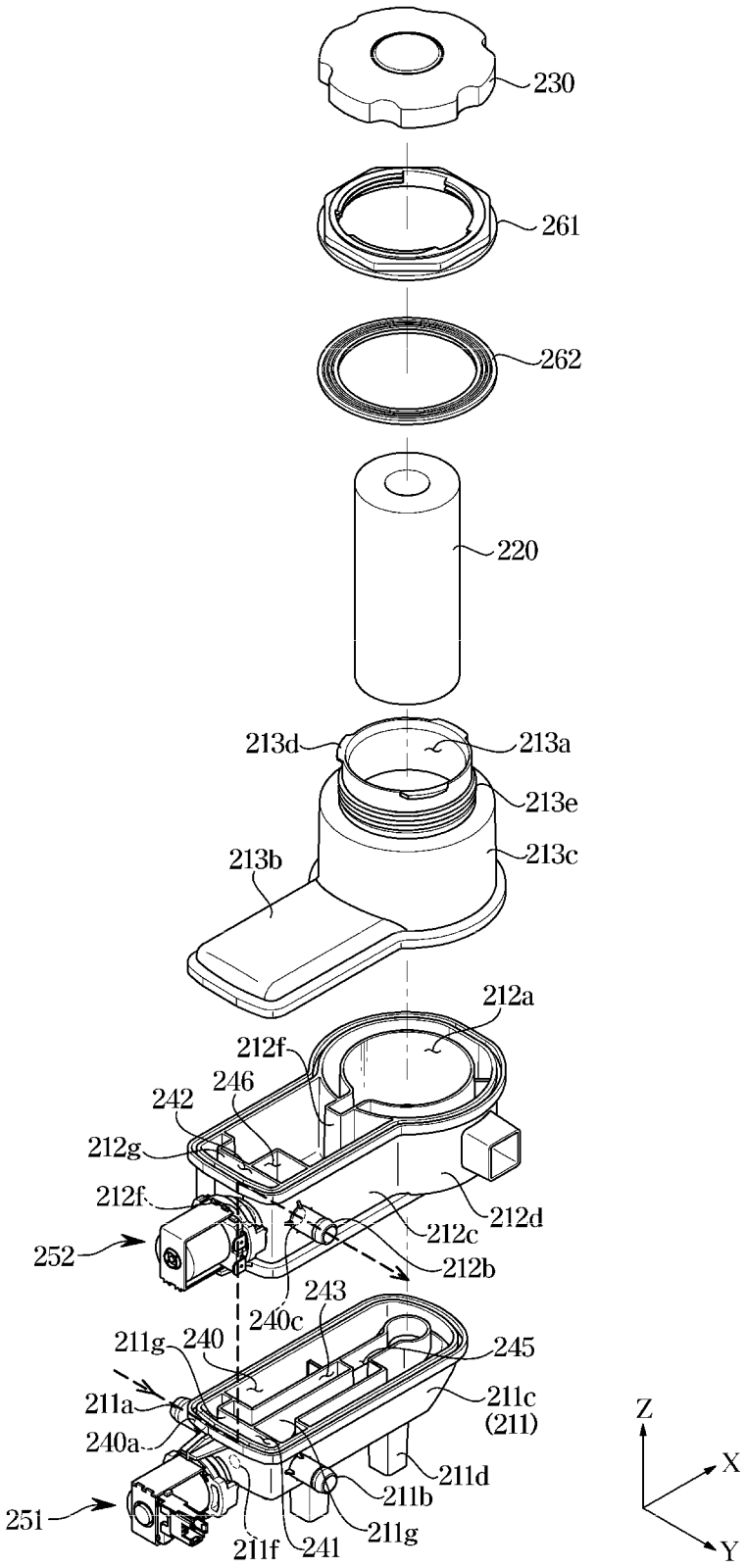
FIG. 14 illustrates a bypass flow path as an example of another flow path formed by a filter assembly.

FIG. 14 illustrates a bypass flow path as an example of another flow path formed by a filter assembly.

Referring to FIG. 14, as the second flow path valve 252 is opened, the water brought into the filter case 210 may flow in the bypass flow path and bypass the filter 220. That is, the water may not be purified but may flow directly to the case brake 100. The bypass flow path may be formed by the inlet 240*a*, the first flow path 241, the second flow path 242 and the second outlet 240*c*. When the second flow path valve 252 is opened, the first flow path valve 251 is closed, leading to blockage of the filtering flow path.

Water supplied from the water supply source 400 may flow into the filter assembly 200 through the inflow tube 211*a*. The water having passed the inflow tube 211*a* may flow into the first flow path 241 through the inlet 240*a*. The water brought into the first flow path 241 may flow into the second flow path 242 formed in the second case 212. The water brought into the second flow path 242 may flow into a flow path in the second flow path valve 252 and then flow out of the second flow path valve 252. The water having passed the second flow path valve 252 may flow through a hole 212*f* formed at the flow path forming wall 212*g* into a sixth flow path 246. The sixth flow path 246 may be connected to the second outlet 240*c*, and water may flow into the case brake 100 through the second outflow tube 212*b*. When the first flow path valve 251 closes the filtering flow path and the second flow path valve 252 opens the bypass flow path, the water brought into the filter case 210 may not pass through the filter 220 but may flow directly into the case brake 100.

Figure 15:
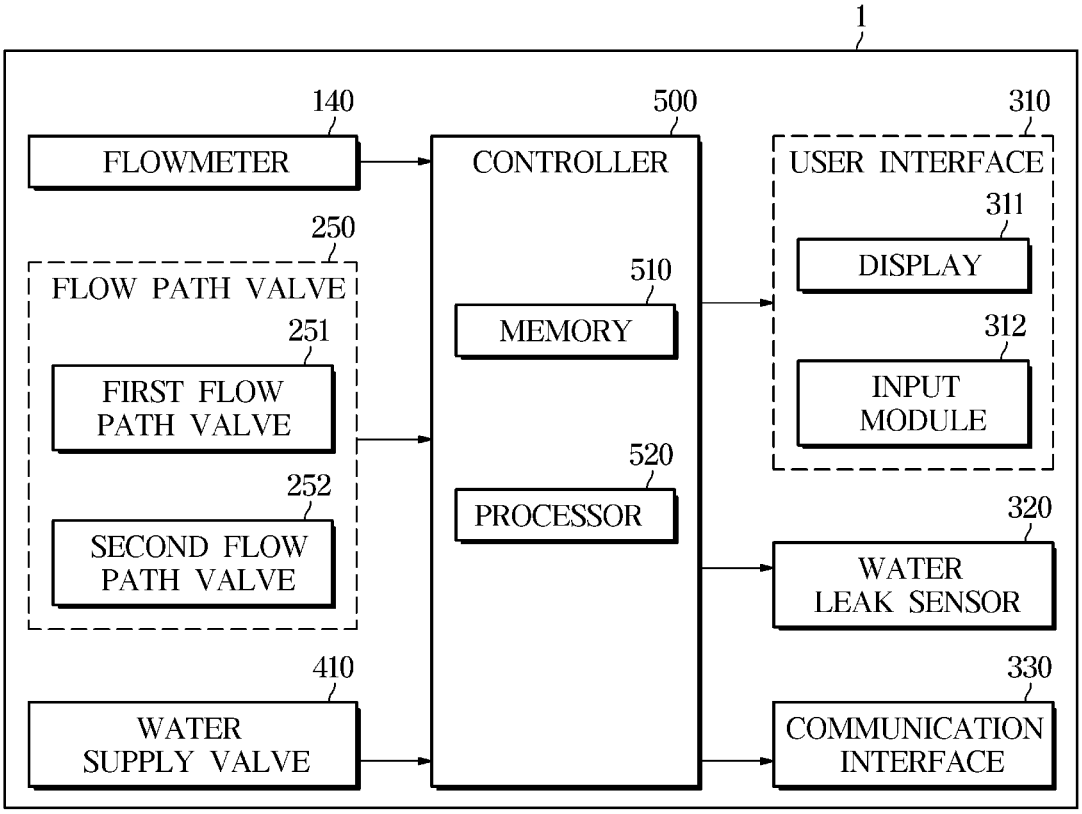
FIG. 15 is a control block diagram of a dish washer, according to an embodiment.

FIG. 15 is a control block diagram of a dish washer, according to an embodiment.

Referring to FIG. 15, the dish washer 1 may include the controller 500. The controller 500 may be electrically connected to the flowmeter 140, the flow path valve 250, the use interface 310, the water leak sensor 320, and a communication interface 330 and control each of the flowmeter 140, the flow path valve 250, the use interface 310, the water leak sensor 320, and the communication interface 330. The controller 500 may include a memory 510 and a processor 520.

The controller 500 may be arranged in the main body 10, and the user interface 310 may be arranged on the door 20. The water leak sensor 320 may be placed on the bottom plate 15 in the machine room L. The controller 500, the user interface 310 and the water leak sensor 320 are not limited to the positions in the above example but may be placed in various positions.

The memory 510 may memorize/store various information required for operation of the dish washer 1. The memory 510 may store instructions, an application, data and/or a program required for operation of the dish washer 1. The memory 510 may include a volatile memory for temporarily storing data, such as a static random access memory (SRAM), or a dynamic random access memory (DRAM). The memory 510 may also include a non-volatile memory for storing data for a long time, such as a read-only memory (ROM), an erasable programmable ROM (EPROM), or an electrically erasable programmable ROM (EEPROM).

The processor 520 may generate control signals for controlling operation of the dish washer 1 based on the instructions, application, data and/or program stored in the memory 510. The processor 520 may include logic circuits and operation circuits in hardware. The processor 520 may process data according to the program and/or instructions provided from the memory 510 and generate a control signal based on the processing result. The memory 510 and the processor 520 may be implemented in one control circuit or in multiple circuits.

The user interface 310 may include a display 311 and an input module 312. The display 311 may display information regarding a state and/or operation of the dish washer 1. The display 311 may display information input by the user or information to be provided for the user in various screens. The display 311 may display information regarding an operation of the dish washer 1 in at least one of an image or text. Furthermore, the display 311 may display a graphic user interface (GUI) that enables the dish washer 1 to be controlled. Hence, the display 311 may display a user interface element (UI element) such as an icon.

The display 311 may include a display panel of various types. For example, the display device 311 may include a liquid crystal display (LCD) panel, a light emitting diode (LED) panel, an organic LED (OLED) panel, or a micro LED panel. Furthermore, the display 311 may be implemented with a touch display.

The input module 312 may output an electric signal (voltage or current) corresponding to a user input to the processor 520. The input module 312 may include various buttons and even a dial. When the display 311 is provided as a touch display, the input module 312 may not be provided separately. For example, the user interface 310 may obtain various user inputs such as a user input to turn on or off the dish washer 1 and a user input to select a washing course.

The communication interface 330 may include a wired communication module and/or a wireless communication module to communicate with an external device (e.g., a mobile device, a computer). The wired communication module may communicate with an external device over a wide area network such as the Internet, and the wireless communication module may communicate with an external device through an access point connected to a wide area network. With this, the user may remotely control the dish washer 1.

A plurality of washing courses for operation of the dish washer 1 may be provided. For example, various washing courses such as an automatic course, a standard course, a power course, a fast course and/or a rinsing/drying course may be provided. The number and/or types of processes included in each washing course may be different. The user may use the user interface 310 to select a washing course.

The washing course may include at least one process. When at least one process is performed, water may be sprayed to dishes placed in the dish washer 1. For example, the standard course may include a preliminary washing process, a main washing process, a rinsing process and a drying process. The preliminary washing process, the main washing process, the rinsing process and the drying process may be sequentially performed. Types of the processes are not limited to the above example.

When a process in which to spray water is performed, water may be supplied to the sump 70 through the water supply source 400, the filer assembly 200, and the case brake 100. For example, in a rinsing process, the water brought into the filter assembly 20 from the water supply source 400 may pass through the filter 220 or bypass the filter 220 and move to the case brake 100.

The processor 520 may control the flow path valve 250 and the water supply valve 410. The water supply valve 410 may be connected and coupled to the water supply source 400. The processor 520 may control the water supply valve 410 to allow or block inflow of water to the dish washer 1 from the water supply source 400. Furthermore, the processor 520 may control the flow path valve 250 to open or close a flow path formed between the water supply valve 410 and the case brake 100 to lead the water to the case brake 100.

The flow path valve 250 may be a solenoid valve. The solenoid valve may open or close a flow path by moving a plunger connected to a piston. However, when a water pressure is applied to a spring and the plunger of the solenoid valve while the solenoid valve is closed or opened, the spring and the plunger of the solenoid valve may not move due to the water pressure.

As there is no other structure that hinders water flows between the water supply valve 410 and the flow path valve 250, when the water supply valve 410 is opened, the water quickly reaches the flow path valve 250 through the inflow tube 211*a* of the filter assembly 200. However, when the water reaches the flow path valve 250 while the flow path valve 250 is closed, the water pressure may hinder the flow path valve 250 from being opened. On the contrary, while the flow path valve 250 is opened, the water applies pressure to the flow path valve 250 while passing the flow path valve 250. When there is an attempt to close the flow path valve 250 while the water pressure is applied to the flow path valve 250, the water pressure may hinder the flow path valve 250 from being closed.

In the traditional dish washer, the flow path valve and the filter are arranged after the case brake to prevent the water pressure from putting the brakes on the valve. In other words, in the traditional dish washer, water supplied from the water supply source passes the case brake first and then flows to the flow path valve and the filter. In the traditional dish washer, a plurality of valves are not arranged successively because of the braking problem of the valves.

To solve these problems, the processor 520 may control the water supply valve 410 and the flow path valve 250 at different points in time at the start or stop of water supply. The processor 520 may control the water supply valve 410 and the flow path valve 250 at different points in time at the start of water supply. The processor 520 may control the water supply valve 410 and the flow path valve 250 at different points in time at the stop of water supply. Specifically, to supply water, the flow path valve 250 and the water supply valve 410 may be sequentially opened, and to stop supplying water, the water supply valve 410 and the flow path valve 250 may be sequentially closed.

In other words, at the start of supplying water, the flow path valve 250 may be opened first and then the water supply valve 410 may be opened. Opening the flow path valve 250 earlier than the water supply valve 410 to supply water may prevent water pressure from being applied to the flow path valve 250. Accordingly, the flow path valve 250 may be easily opened without hindrance of water pressure. To stop supplying water, the water supply valve 410 may be closed first and then the flow path valve 250 may be closed. Closing the water supply valve 410 earlier to stop supplying water may prevent water pressure from being applied to the flow path valve 250. Accordingly, the flow path valve 250 may be easily closed.

The processor 520 may determine operation of the water supply valve 410 and operation of one of the plurality of flow path valves 250, based on at least one process included in a washing course. The processor 520 may determine opening of the bypass flow path or opening of the filtering flow path based on at least one process included in a washing course.

When water supply into the dish washer 1 is not required, both the bypass flow path and the filtering flow path may remain closed. In other words, in a case that water supply into the dish washer 1 is not required, both the first flow path valve 251 and the second flow path valve 252 may be kept closed. Based on at least one process included in a washing course, the processor 520 may selectively open the first flow path valve 251 and the second flow path valve 252 when water supply is required.

The processor 520 may open one of the first flow path valve 251 and the second flow path valve 252 and close the other one to open the filtering flow path or the bypass flow path. When the filtering flow path is opened, the bypass flow path may be closed, and when the bypass flow path is opened, the filtering flow path may be closed.

When the filtering flow path is required to be opened to supply water to the filter 220, the processor 520 may open the first flow path valve 251 first and then open the water supply valve 410. When the filtering flow path is required to be closed to stop supplying water, the processor 520 may close the water supply valve 410 first and then close the first flow path valve 251.

When the bypass flow path that bypasses the filter 220 is required to be opened, the processor 520 may open the second flow path valve 252 first and then open the water supply valve 410. When the bypass flow path is required to be closed to stop supplying water, the processor 520 may close the water supply valve 410 first and then close the second flow path valve 252.

For example, the processor 520 may control the flow path valve 250 for the water purified by the filter 220 to flow to the sump 70 to enter at least one rinsing process. Especially, the processor 520 may open the first flow path valve 251 and close the second flow path valve 252 to open the filtering flow path to enter the last rinsing process. As the filtered water is used only for a predetermined process (e.g., the last rinsing course), a period of use of the filter 220 may increase. With the increasing period of use of the filter 220, maintenance costs of the dish washer 1 may be reduced.

However, a process that uses the filtering flow path may vary depending on a design. It is also possible to allow passage through the filter 220 only in the first rinsing course. It is also possible to allow the water to pass through the filter 220 or not to pass through the filter 220 in all processes required to spray water into the tub 12.

Furthermore, the processor 520 may control the first flow path valve 251 and/or the second flow path valve 252 to open the filtering flow path or the bypass flow path based on a user input obtained through the user interface 310. The user may manipulate the user interface 310 to set a purification function or release the purification function. When the purification function is set, the first flow path valve 251 may be opened to open the filtering flow path to supply water, and the second flow path valve 252 may be closed to close the bypass flow path.

The user may select whether to use purified water in each process of the dish washer 1 (i.e., whether to use the purification function). For example, the processor 520 may set to use the purified water in the last rinsing process and set to use non-purified water in the other processes based on a user input. As the user is able to select whether to use the purified water when the dish washer 1 is operated, convenience of the user may increase.

The water leak sensor 320 may detect water leaking out from the filter assembly 200. The water leak sensor 320 may be arranged on the bottom plate 15 to be able to detect a water leak from the filter assembly 200, and may send the water leak information to the controller 500. The controller 500 may control the user interface 300 to provide a notification of a water leak from the filter assembly 200 (e.g., a water leak warning) based on the water leak information sent from the water leak sensor 320.

Furthermore, the processor 520 may determine whether to provide a notification of filter replacement based on at least one of a number of times of opening the first flow path valve 251, opening hours of the first flow path valve 251 or a period elapsed after installation of the filter 220. Moreover, the processor 520 may determine whether to provide the notification of filter replacement based on an amount of accumulated water having passed through the filter 220 and flowing into the case brake 100. The amount of the water flowing into the case brake 100 may be measured by the flowmeter 140.

The processor 520 may accumulate the number of times of opening the first flow path valve 251, and control the user interface 310 to provide a notification of filter replacement based on the accumulated number of times of opening the first flow path valve 251 being a preset limited number (e.g., 380). When the first flow path valve 251 is opened, the filtering flow path is opened and water flows into the filter 220, so the opening of the first flow path valve 251 may imply that the filter 220 is used. For example, when the accumulated number of times of opening the first flow path valve 251 reaches 380, the processor 520 may determine that the filter 220 needs to be replaced and may control the user interface 310 to indicate a notification of filter replacement.

The processor 520 may determine hours of use of the filter 220 by accumulating opening hours of the first flow path valve 251, and control the user interface 310 to provide a notification of filter replacement based on the hours of use of the filter 220 being preset limited hours (e.g., 5,000 hours). The opening hours of the first flow path valve 251 may refer to actual hours for which the filter 220 has been used, i.e., hours for which purification has been performed. For example, when the hours of use of the filter 220 reaches 5,000 hours, the processor 520 may determine that the filter 220 needs to be replaced and may control the user interface 310 to indicate a notification of filter replacement. The opening hours of the first flow path valve 251 may be equal to hours for which a process requiring to use the filtering flow path is performed.

The processor 520 may control the user interface 310 to provide a notification of filter replacement based on a period elapsed after installation of the filter 220 corresponding to a recommended period for replacement (e.g., one year). When the filter 220 has not been often used but the time has long passed after the filter 220 was installed in the dish washer 1, performance of the filter 220 may be degraded and the filter 220 may have been contaminated. Hence, providing the notification of filter replacement when the recommended period for replacement has elapsed after installation of the filter 220 may lead to hygienic use of the dish washer 1.

The processor 520 may calculate an accumulated amount of water having passed through the filter 220 and flowing into the case brake 100 after the first flow path valve 251 is opened, and determine whether to provide a notification of filter replacement based on the accumulated amount of water calculated. For example, when the accumulated amount of water having passed through the filter 220 and flowing into the case brake 100 reaches a limited amount of water (e.g., 5,000 litters), the processor 520 may control the user interface 310 to provide a notification of filter replacement. The processor 520 may determine a value measured by the flowmeter 140 after the first flow path valve 251 is opened as an amount of water having passed through the filter 220.

When one or more of the number of times of opening the first flow path valve 251, hours of use of the filter 220, a period elapsed after installation of the filter 220 and an amount of water having passed through the filter 220 reach a limited value, the processor 520 may control the user interface 310 to display a notification of filter replacement.

Furthermore, the processor 520 may control the flow path valve 250 and the water supply valve 410 to stop supplying water until the filter 220 is replaced after the notification of filter replacement is provided.

Figure 16:
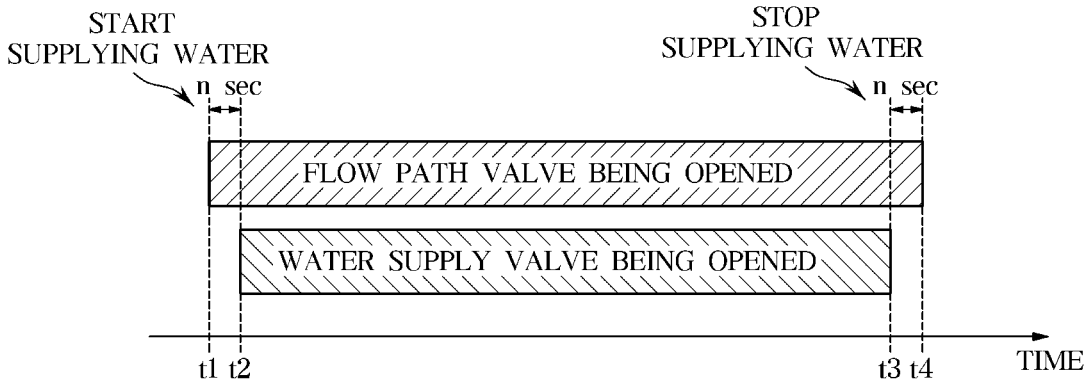
FIG. 16 is a time sequence chart illustrating control timing of a water supply valve and a valve of a filter assembly.

FIG. 16 is a time sequence chart illustrating control timing of a water supply valve and a valve of a filter assembly.

Referring to FIG. 16, the processor 520 of the dish washer 1 may determine to start or stop supplying water based on at least one process included in a washing course. For example, a program and/or software for a rinsing process may include an instruction to start supplying water and an instruction to stop supplying water. The processor 520 may open the flow path valve 250 at time t1, and after n seconds (e.g., 1 second) elapses, open the water supply valve 410 at time t2. Depending on whether to use purified water, the first flow path valve 251 or the second flow path valve 252 may be opened at time t1.

The water supply valve 410 may remain opened until time t3 at which the instruction to stop supplying water is placed. The flow path valve 250 may remain opened until time t4 after n seconds (e.g., 1 second) elapses from time t3. The processor 520 may close the water supply valve 410 at time t3 based on the instruction to stop supplying water, and close the flow path valve 250 at time t4. When the first flow path valve 251 is opened at time t1, the first flow path valve 251 may be closed at time t4. Alternatively, when the second flow path valve 252 is opened at time t1, the second flow path valve 252 may be closed at time t4.

In this way, by sequentially controlling the flow path valve 250 and the water supply valve 410 to start or stop supplying water, a situation in which the flow path valve 250 is not operated due to water pressure may be prevented.

Figure 17:
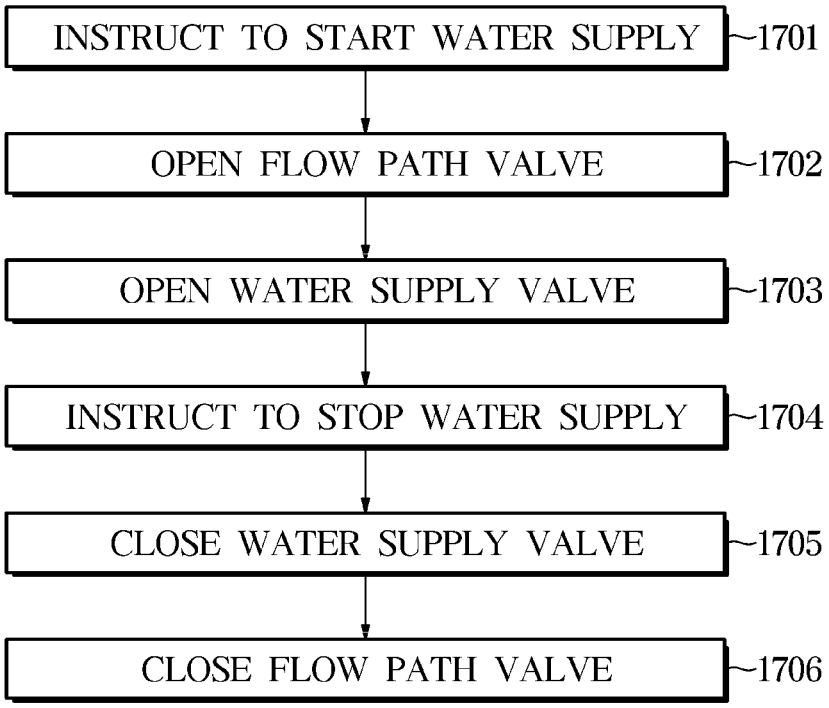
FIG. 17 is a flowchart illustrating a method of controlling a valve of a dish washer, according to an embodiment.
Figure 18:
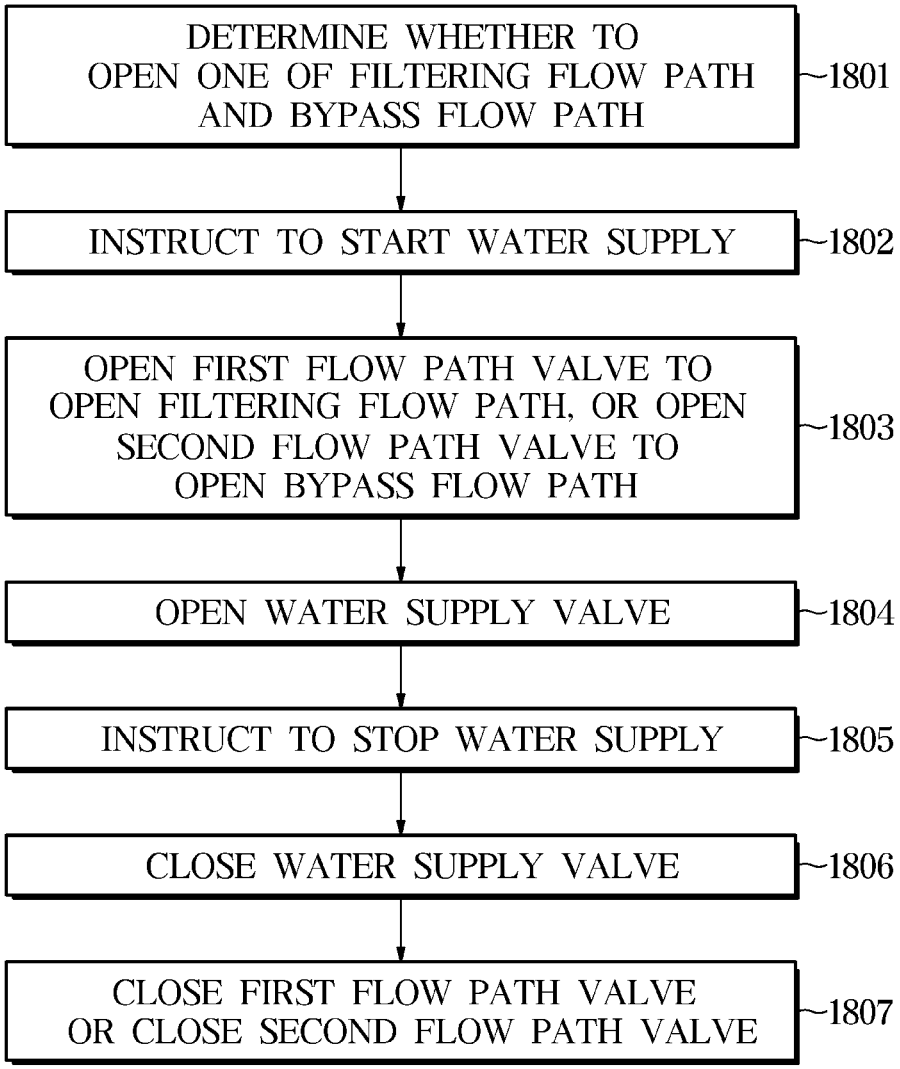
FIG. 18 is a flow chart illustrating the method of controlling the dish washer described in FIG. 17 in more detail.

FIG. 17 is a flowchart illustrating a method of controlling a valve of a dish washer, according to an embodiment. FIG. 18 is a flow chart illustrating a method of controlling the dish washer described in FIG. 17 in more detail.

Referring to FIG. 17, the processor 520 of the dish washer 1 may determine whether to start supplying water based on at least one process (e.g., a rinsing process) included in a washing course, in operation 1701. A program and/or software for performing a process may include an instruction to start supplying water and an instruction to stop supplying water. Furthermore, the processor 520 may determine to operate one of the plurality of flow path valves 250 included in the filter assembly 200 to supply water into the dish washer 1. In other words, the processor 520 may determine to open the first flow path valve 251 or open the second flow path valve 252 when water supply is required.

The processor 520 may open the flow path valve 250 first to start supplying water, in operation 1702. The processor 520 may open the water supply valve 410 based on the passage of a preset time after the flow path valve 250 is opened, in operation 1703. As both the flow path valve 250 and the water supply valve 410 are opened, water may flow to the filter assembly 200 from the water supply source 400. Opening the flow path valve 250 earlier than the water supply valve 410 to start supplying water may prevent water pressure from being applied before the flow path valve 250 is opened.

The processor 520 may determine to stop supplying water based on completion of a process (e.g., a rinsing process), in operation 1704. The processor 520 may determine that the process has been completed when a preset period of time for which the process is performed has elapsed. The processor 520 may read out and deal with the instruction to stop supplying water at a time of completion of the process. The processor 520 may close the water supply valve 410 first to stop supplying water, in operation 1705. The processor 520 may close the water supply valve 250 based on the passage of a preset time after the water supply valve 410 is closed, in operation 1706. By closing the water supply valve 410 first to stop supplying water, the water pressure that has been applied to the flow path valve 250 may be removed. Accordingly, the flow path valve 250 may be easily operated.

Referring to FIG. 18, the processor 250 may determine whether to open one of the filtering flow path and the bypass flow path based on at least one process included in a washing course, in operation 1801. For example, the processor 520 may determine to open the filtering flow path in the last rinsing process.

The processor 520 may read out and deal with the instruction to start supplying water at a time to enter a process. The processor 520 may open the first flow path valve 251 to open the filtering flow path or open the second flow path valve 252 to open the bypass flow path based on the instruction to start supplying water, in operation 1802 and operation 1803. The processor 520 may open one of the first flow path valve 251 and the second flow path valve 252 and close the other one. For example, the first flow path valve 251 may be opened and the second flow path valve 252 may be closed to open the filtering flow path in the last rinsing process.

The process 520 may open the first flow path valve 251 or the second flow path valve 252 and then open the water supply valve 410, in operation 1804. In this way, opening the flow path valve 250 earlier than the water supply valve 410 to start supplying water may prevent water pressure from being applied to the flow path valve 250 before the flow path valve 250 is opened.

The processor 520 may determine to stop supplying water based on completion of the process, in operation 1805. The processor 520 may determine that the process has been completed when a preset period of time for which the process is performed has elapsed. The processor 520 may read out and deal with the instruction to stop supplying water at a time of completion of the process. The processor 520 may close the water supply valve 410 to stop supplying water in operation 1806, and after this, close the first flow path valve 251 or the second flow path valve 252 in operation 1807. By closing the water supply valve 410 first to stop supplying water, the water pressure that has been applied to the flow path valve 250 may be removed. Accordingly, the flow path valve 250 may be easily operated.

Figure 19:
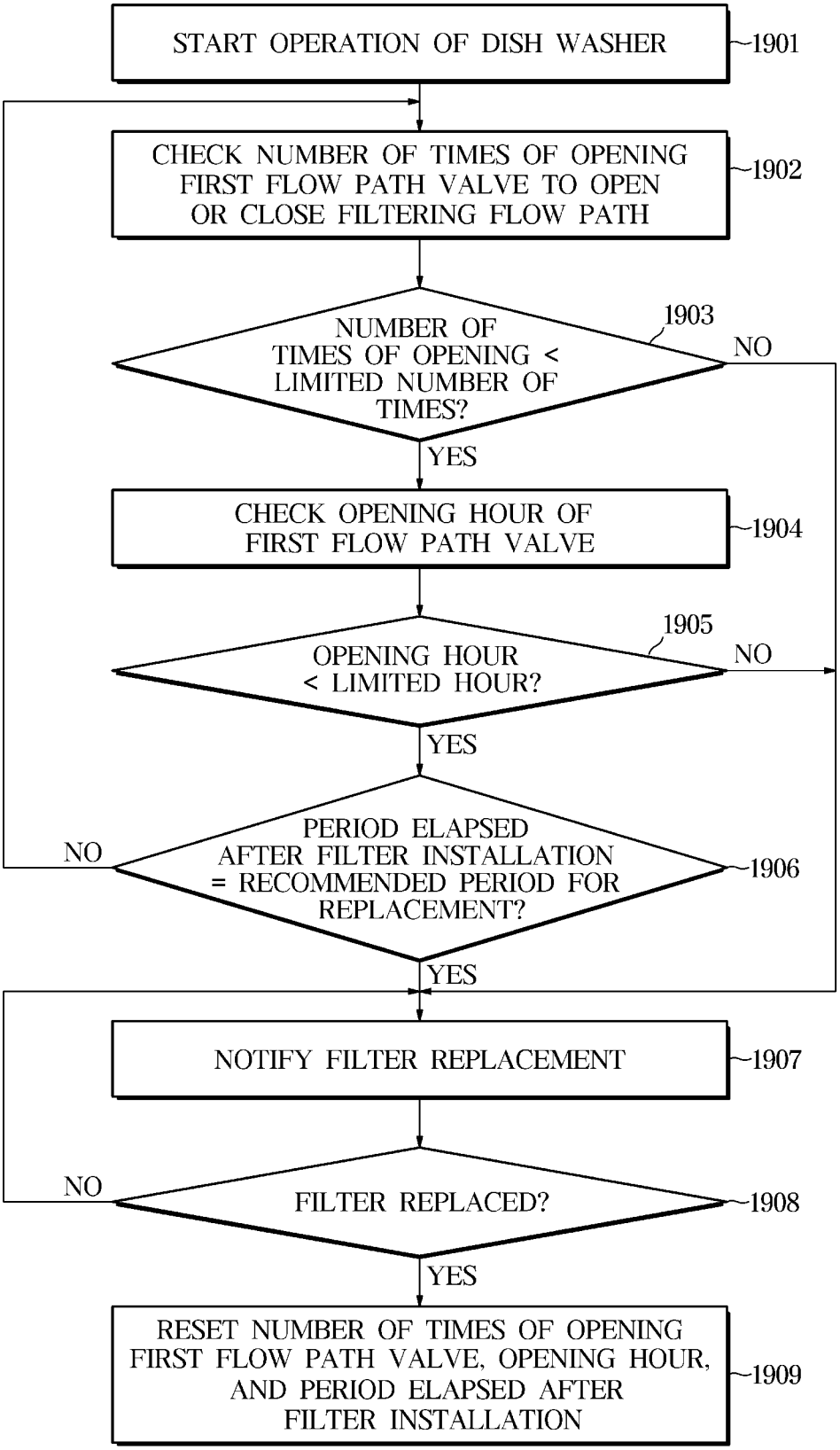
FIG. 19 is a flowchart illustrating a method of providing a notification of filter replacement of a dish washer, according to an embodiment.

FIG. 19 is a flowchart illustrating a method of providing a notification of filter replacement of a dish washer, according to an embodiment.

Referring to FIG. 19, when the dish washer is started to be operated in operation 1901, the processor 520 of the dish washer 1 may determine the number of times of opening the first flow path valve 251 to open or close the filtering flow path in operation 1902. The processor 520 may control the user interface 310 to provide a notification of filter replacement based on the accumulated number of times of opening the first flow path valve 251 being a preset limited number (e.g., 380), in operation 1903 and operation 1907. When the first flow path valve 251 is opened, the filtering flow path is opened and water flows into the filter 220, so the opening of the first flow path valve 251 may imply that the filter 220 is used. For example, when the accumulated number of times of opening the first flow path valve 251 reaches 380, the processor 520 may determine that the filter 220 needs to be replaced and may control the user interface 310 to indicate a notification of filter replacement.

When the number of times of opening the first flow path valve 251 is smaller than the preset limited number, the processor 520 may check opening hours of the first flow path valve 251, in operation 1904. The processor 520 may control the user interface 310 to provide a notification of filter replacement based on the opening hours of the first flow path valve 251 being preset limited hours (e.g., 5,000 hours), in operation 1905 and operation 1907. The opening hours of the first flow path valve 251 may refer to actual hours for which the filter 220 has been used, i.e., hours for which purification has been performed. For example, when the hours of use of the filter 220 reaches 5,000 hours, the processor 520 may determine that the filter 220 needs to be replaced and may control the user interface 310 to indicate a notification of filter replacement.

When the opening hours of the first flow path valve 251 is smaller than the preset limited hours, the processor 520 may check a period elapsed after installation of the filter 220. The processor 520 may control the user interface 310 to provide a notification of filter replacement based on the period elapsed after installation of the filter 220 corresponding to a recommended period for replacement (e.g., one year) in operation 1906 and operation 1907.

The processor 520 may detect whether to replace the filter 220, in 1908. For example, based on detection of a user input pressing a reset button provided on the user interface 310, the processor 520 may identify that filter 220 has been replaced. In another example, there may be an extra filter sensor (not shown) arranged to detect the filter 220.

The processor 520 may reset the number of times of opening the first flow path valve 251, the opening hours of the first flow path valve 251 (hours of use of the filter 220), and the period elapsed after installation of the filter 220 in response to replacement of the filter 220.

Although it was described in FIG. 19 that the number of times of opening the first flow path valve 251, the opening hours of the first flow path valve 251 and the period elapsed after installation of the filter 220 are sequentially checked, the disclosure is not limited to the aforementioned sequence. In other words, the number of times of opening the first flow path valve 251, the opening hours of the first flow path valve 251 and the period elapsed after installation of the filter 220 may be separately checked regardless of the sequence.

Furthermore, when the accumulated amount of water having passed through the filter 220 and flowing into the case brake 100 reaches a limited amount of water (e.g., 5,000 litters), the processor 520 may control the user interface 310 to provide a notification of filter replacement.

When one or more of the number of times of opening the first flow path valve 251, hours of use of the filter 220, a period elapsed after installation of the filter 220 and an amount of water having passed through the filter 220 reach a limited value, the processor 520 may control the user interface 310 to display a notification of filter replacement.

A dish washer and method for controlling the same as disclosed herein may increase the lifespan of a filter by forcing water supplied from a water supply source to bypass the filter and flow to a case brake or to pass through the filter and flow to the case brake.

The dish washer and method for controlling the same as disclosed herein may prevent blockage of a flow path, in which water flows, by sequentially controlling a water supply valve connected to the water supply source and a valve installed in a filter assembly.

Furthermore, the dish washer and method for controlling the same as described herein may determine the remaining lifespan of the filter and provide a notification of filter replacement. The notification of filter replacement may be provided at a proper time to induce the user to replace the filter, thereby increasing hygiene and facilitation of management of the dish washer.

The aforementioned methods according to the various embodiments of the disclosure may be provided in a computer program product. The computer program product may be a commercial product that may be traded between a seller and a buyer. The computer program product may be distributed in the form of a storage medium (e.g., a compact disc read only memory (CD-ROM)), through an application store (e.g., Play Store™), directly between two user devices (e.g., smart phones), or online (e.g., downloaded or uploaded). In the case of online distribution, at least part of the computer program product (e.g., a downloadable app) may be at least temporarily stored or arbitrarily created in a storage medium that may be readable to a device such as a server of the manufacturer, a server of the application store, or a relay server.

The embodiments of the disclosure have thus far been described with reference to accompanying drawings. It will be obvious to those of ordinary skill in the art that the disclosure may be practiced in other forms than the embodiments as described above without changing the technical idea or essential features of the disclosure. The above embodiments are only by way of example, and should not be construed in a limited sense.

The disclosure provides a dish washer and method for controlling the same, which enables water supplied from a water supply source to bypass a filter and flow into a case brake or to pass through the filter and flow into the case brake.

The disclosure provides a dish washer and method for controlling the same, capable of preventing blockage of a flow path, in which water moves, by controlling a water supply valve connected to the water supply source and a valve installed at a filter assembly.

The disclosure also provides a dish washer and method for controlling the same, capable of providing a notification of replacement of the filter.

A dish washer and method for controlling the same as disclosed herein may increase the lifespan of a filter by forcing water supplied from a water supply source to bypass the filter and flow to a case brake or to pass through the filter and flow to the case brake.

The dish washer and method for controlling the same as disclosed herein may prevent blockage of a flow path, in which water flows, by sequentially controlling a water supply valve connected to the water supply source and a valve installed in a filter assembly.

Furthermore, the dish washer and method for controlling the same as described herein may determine the remaining lifespan of the filter and provide a notification of filter replacement. The notification of filter replacement may be provided at a proper time to induce the user to replace the filter, thereby increasing hygiene and facilitation of management of the dish washer.

What is claimed is:

1. A dish washer comprising:

a cabinet;

a tub in the cabinet;

a sump underneath the tub;

a case brake on a side wall of the tub located higher than the sump to prevent a backflow of water collected in the sump to the case brake;

a water supply valve connected to an external water supply source;

a filter assembly between the water supply valve and the case brake, the filter assembly including:

a plurality of flow path valves to open or close a plurality of flow paths corresponding to the plurality of flow path valves to guide water supplied from the external water supply source to the case brake; and a processor configured to:

open one of the plurality of flow path valves at a first point in time;

while the one of the plurality of flow path valves is opened, open the water supply valve at a second point in time to start supplying of the water;

while the one of the plurality of flow path valves is remained opened, close the opened water supply valve at a third point in time to stop the supplying of the water; and close the opened one of the plurality of flow path valves at a fourth point in time, wherein the case brake connected to the filter assembly and the sump, respectively, and is configured to guide water received from the filter assembly to the sump, and wherein the case brake comprises:

a case;

an inflow tube that guides water discharged from the filter assembly to an internal flow path of the case;

an outflow tube that guides water passing through the internal flow path of the case to the sump;

a sump drain connection tube that guides water discharged from the sump into the case; and a drain hose connection tube that drains water discharged from the case to outside.

2. The dish washer of claim 1, wherein the plurality of flow paths includes a filtering flow path and a bypass flow paths, and the plurality of flow path valves comprises:

a first flow path valve to open or close the filtering flow path in which the water supplied from the external water supply source passes through a filter in the filter assembly and flows to the case brake; and a second flow path valve to open or close the bypass flow path in which the water supplied from the external water supply source bypasses the filter and flows to the case brake.

3. The dish washer of claim 2, wherein the processor is configured to open the water supply valve after opening the first flow path valve or the second flow path valve first to start the supplying of the water.

4. The dish washer of claim 2, wherein the processor is configured to close the first flow path valve or the second flow path valve after closing the water supply valve first to stop the supplying of the water.

5. The dish washer of claim 2, wherein the processor is configured to control the first flow path valve or the second flow path valve to open one of the filtering flow path and the bypass flow path based on at least one process included in a washing course.

6. The dish washer of claim 5, wherein the processor is configured to control the first flow path valve to open the filter flow path for a last rinsing process of the at least one process.

7. The dish washer of claim 2, wherein the processor is configured to determine whether to provide a notification of a filter replacement based on at least one of a number of times that the first flow path valve has opened, hours that the first flow path valve has opened and a period of time elapsed after an installation of the filter.

8. The dish washer of claim 7, further comprising a user interface, wherein the processor is configured to accumulate the number of times that the first flow path valve has opened, and control the user interface to provide the notification of the filter replacement based on the accumulated number of times being equal to a preset limited number.

9. The dish washer of claim 7, further comprising a user interface, wherein the processor is configured to determine hours of use of the filter by accumulating the hours that the first flow path valve has opened, and control the user interface to provide the notification of the filter replacement based on the hours of use of the filter being equal to preset limited hours.

10. The dish washer of claim 7, further comprising a user interface, wherein the processor is configured to control the user interface to provide the notification of filter replacement based on a period of time elapsed after the installation of the filter corresponding to a recommended period of time for the filter replacement.

11. The dish washer of claim 7, further comprising a flowmeter measuring an amount of water flowing into the case brake, wherein the processor is configured to calculate an accumulated amount of water having passed through the filter and flowing into the case brake after the first flow path valve is opened, and determining whether to provide the notification of the filter replacement based on the accumulated amount of water calculated.

12. A method of controlling a dish washer including a sump, a filter assembly, and a case brake configured to guide water received from the filter assembly to the sump and located higher than the sump to prevent a backflow of water collected in the sump to the case brake, the case brake comprising a case, an inflow tube that guides water discharged from the filter assembly to an internal flow path of the case, an outflow tube that guides water passing through the internal flow path of the case to the sump, a sump drain connection tube that guides water discharged from the sump into the case, and a drain hose connection tube that drains water discharged from the case to outside, the method comprising:

determining, by a processor, at least one process to perform included in a washing course;

based on the determining of the at least one process to perform, determining whether to operate a water supply valve, connected to an external water supply source, and to operate one of a plurality of flow path valves included in a filter assembly, to open or close one of a plurality of flow paths corresponding to the one of the plurality of flow path valves to guide the water supplied from the external water supply source to the case brake; and based on the determining whether to operate the water supply valve and the one of the plurality of flow path valves:

opening one of the plurality of flow path valves at a first point in time;

while the one of the plurality of flow path valves is opened, opening the water supply valve at a second point in time to start supplying of the water; and while the one of the plurality of flow path valves is remained opened, closing the water supply valve at a third point in time to stop the supplying of the water; and closing the opened one of the plurality of flow path valves at a fourth point in time.

13. The method of claim 12, wherein the plurality of flow path valves comprises:

a first flow path valve to open or close a filtering flow path in which the water supplied from the external water supply source passes through a filter in the filter assembly and flows to the case brake; and a second flow path valve to open or close a bypass flow path in which the water supplied from the external water supply source bypasses the filter and flows to the case brake, wherein the determining whether to operate of comprises determining whether to operate the first flow path valve or the second flow path valve to open the one of the filtering flow path and the bypass flow path, based on the determined at least one process.

14. The method of claim 13, wherein the opening of the water supply valve and one of the plurality of flow path valves comprises opening the water supply valve after opening the first flow path valve or the second flow path valve first to start the supplying of the water.

15. The method of claim 13, wherein the closing of the water supply valve and the one of the plurality of flow path valves comprises closing the first flow path valve or the second flow path valve after closing the water supply valve first to stop the supplying of the water.

16. The method of claim 13, wherein the operating of the first flow path valve to open the filtering flow path is performed in a last rinsing process of the at least one process.

17. The method of claim 12, further comprising determining whether to provide a notification of a filter replacement based on at least one of a number of times that the first flow path valve has opened, hours that the first flow path valve has opened or a period of time elapsed after an installation of the filter.

18. The method of claim 17, wherein the determining of whether to provide the notification of the filter replacement comprises accumulating the number of times that the first flow path valve has opened and providing the notification of the filter replacement based on the accumulated number of times being equal to a preset limited number.

19. The method of claim 17, wherein the determining of whether to provide the notification of the filter replacement comprises determining hours of use of the filter by accumulating hours that the first flow path valve has opened and providing the notification of the filter replacement based on the hours of use of the filter being equal to preset limited hours.

20. The method of claim 17, wherein the determining of whether to provide the notification of the filter replacement comprises providing the notification of the filter replacement based on the period of time elapsed after the installation of the filter corresponding to a recommended period of time for the filter replacement.

* * * * *